US006286931B1

(12) United States Patent
Kawakami et al.

(10) Patent No.: US 6,286,931 B1
(45) Date of Patent: Sep. 11, 2001

(54) INK JET RECORDING APPARATUS

(75) Inventors: Kazuhisa Kawakami; Nobutoshi Ohtsuka; Seiji Mochizuki; Yoji Sasai; Atsushi Kobayashi; Kazuhisa Takeda; Masahiro Isono, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/977,657

(22) Filed: Nov. 24, 1997

(30) Foreign Application Priority Data

Nov. 22, 1996 (JP) ..... 8-327836
Nov. 22, 1996 (JP) ..... 8-327837

(51) Int. Cl.[7] ..... B41J 2/165; B41J 2/01; B41J 3/407

(52) U.S. Cl. ..... 347/32; 347/23; 347/32; 347/104; 347/106

(58) Field of Search ..... 347/32, 23, 104, 347/8, 101, 106, 22; 358/296, 300, 304, 285

(56) References Cited

U.S. PATENT DOCUMENTS 4,581,618 * 4/1986 Watanabe et al. ..... 347/104
5,343,773 * 9/1994 Lehna ..... 347/32
5,831,644 * 11/1998 Kato ..... 347/22

FOREIGN PATENT DOCUMENTS

313204 A 4/1989 (EP) .
0 313 204 * 4/1989 (EP) ..... 347/32
480302 A 4/1992 (EP) .
0 526 209 2/1993 (EP) ..... B41J/2/165
604068 A 6/1994 (EP) .
635371 A 1/1995 (EP) .
653306 A 5/1995 (EP) .
0 659 571 6/1995 (EP) ..... B41J/13/00
720912 A 7/1996 (EP) .
724959 A 8/1996 (EP) .
0 744 293 11/1996 (EP) ..... B41J/2/165

* cited by examiner

*Primary Examiner*—Huan Tran
*Assistant Examiner*—Charles W. Stewart, Jr.
(74) *Attorney, Agent, or Firm*—Sughrue, Mion, Zinn, Macpeak & Seas, PLLC

(57) ABSTRACT

An ink jet recording apparatus having a sheet forward roller 8 and a pump unit 11 connected to a single drive motor 7, and a drive force is transmitted to the pump unit 11 through time lag mechanisms 33–34 that cause a time lag at the time of switching rotational directions. Sheet feeding/discharging operation and ink sucking operation are performed with the single drive motor by taking advantage of a timing at which there are no load fluctuations accompanied by the switching operation, without requiring any switching mechanism.

28 Claims, 22 Drawing Sheets

INK JET RECORDING APPARATUS

FIELD OF THE INVENTION

The invention relates to ink jet recording apparatuses in general, and more particularly to an ink jet recording apparatus featuring a mechanism that causes a single drive motor to perform both a recording head maintaining operation and a recording sheet feeding/discharging operation.

BACKGROUND OF THE INVENTION

An ink jet recording apparatus requires a drive system for performing a recording sheet feeding/discharging operation and a recording head maintaining operation, in addition to carriage travelling operation. Conventionally, printers have a switching mechanism that enables a single drive motor to perform these sheet feeding/discharging and recording head maintaining operations in order to miniaturize and reduce the price of the apparatus.

The switching mechanism switches a drive force of a sheet forward motor between a pump drive system and a sheet feed/discharge drive system when the carriage has moved from a home position to a printing region and when the carriage has moved from the printing region to the home position. This switching feature involves selectively meshing a switching gear with gears of the sheet feed/discharge system and with gears of the pump system such a switching feature is generally thought to be acceptable, however, it is not without shortcomings. In particular, the gears cannot be meshed with each other smoothly because they are not phased together. As a result, sheet feed timings may be disturbed. Furthermore, conventional apparatuses require a disadvantageously large number of components.

Further, an ink jet recording apparatus includes a cleaning mechanism be disposed in a region outside a data recording region to maintain a recording head in a satisfactory condition at all times. As a result, the width of the apparatus is necessarily increased. The increased width is especially disadvantageous in an ink jet recording apparatus dedicated to color printing. For example, same apparatuses use yellow, magenta, cyan, and black inks and further use two kinds of inks, dark and light, for each of these colors. Consequently, the recording head that jets these inks in the form of ink droplets is necessarily increased. Also, capping unit and the cleaning mechanism whose size depends on the size of the recording head are necessarily large-sized. As a result, if the carriage, the recording head, the capping unit, and the cleaning mechanism are disposed within the housing at a high density in an effort to miniaturize the recording apparatus, the printing margins disadvantageously are reduced. For example, the cleaning mechanism may inadvertently move into the carriage travelling path such that during the recording operation, the cleaning mechanism contacts the carriage, thereby disturbing the recording operation.

Further, the number of nozzle openings of the black recording head for jetting black ink and of the color recording head for jetting three kinds of color inks is increased in order to accommodate the needs for high-density and high-speed printing. In association therewith, if the sizes of the recording heads in the sheet forward direction and in the sheet width direction are increased, the sizes of the caps for sealing the respective recording heads are necessarily increased. As a result, the sealability of the caps is impaired due to displacements or the like at the time the caps come into contact with the recording heads.

SUMMARY OF THE INVENTION

The invention is applied to an ink jet recording apparatus wherein a single drive means capable of switching rotational directions between a forward direction and a reverse direction is coupled to recording sheet feed/discharge means and to ink sucking means so that a recording sheet discharging operation and an ink sucking operation are performed while the drive means is rotating in the reverse direction, the drive means being coupled to the ink sucking means through coupling means for causing a time lag at the time of switching the rotational directions.

Further, the invention is applied to an ink jet recording apparatus having a capping unit, the capping unit including: a slider being biased by a recording head or a carriage carrying the recording head and thereby following a movement of the carriage over a base table while vertically moving in coincidence with the movement of the carriage; a holder being held by the slider while urged toward the recording head by springs on both sides outside a sealing region of the recording head; and a cap for sealing a nozzle surface of the recording head, the cap being accommodated in the holder and being made of an elastic member.

Therefore, a first object of the invention is to provide an ink jet recording apparatus that can not only implement accurate sheet feeding/discharging operation without being affected by load fluctuations accompanied by the ink sucking operation by means of taking advantage of a time lag in transmitting a drive force to the ink sucking means, but also significantly simplify the drive system of the recording apparatus of this type, and thus curtail costs, miniaturize the apparatus, and reduce the time required for sequential operations by means of dispensing with a separately arranged drive force switching mechanism.

A second object of the invention is to provide an ink jet recording apparatus that can keep the ink sucking operation inoperative during recording operation by means of allowing both the sheet discharging operation by the sheet feed/discharge means and the ink sucking operation to be performed while the drive means is being rotated in a reverse direction.

A third object of the invention is to provide an ink jet recording apparatus that prevents disturbing the recording operation. That is, the apparatus can be further miniaturized by means of movably arranging the capping means of the recording head so as to enter into and overlap the cleaning means operating region. Therefore, the width of the capping means is reduced by a dimension equal to the overlap of the operating region of the cleaning means. At the same time, the apparatus can prevent the recording operation from being disturbed by having one side of the capping means function as a stopper surface to block the cleaning means from projecting. That is, the stopper surface prevents to the cleaning means from projecting and contacting the recording head as a result of the sheet forward motor having rotated in a direction opposite to the sheet forward direction.

Further, another object of the invention is to provide an ink jet recording apparatus that can record images at both side margins of a recording sheet, even in the case of using a large-sized carriage carrying a color ink tank, by allowing part of the carriage that is scanning to enter into the home position, while causing a guide means to locate the capping means having entered into the cleaning means operating region to a position where the capping means does not come in contact with the recording head.

Another object of the invention is to provide an ink jet recording apparatus that can implement highly accurate sheet forwarding by directly connecting the cleaning means or the ink sucking means to the sheet feed/discharge means through a transmission mechanism different from a transmission mechanism that transmits motive force to the sheet feed/discharge means. That is, as a result of such direct connection, backlashes caused by repetitive forward and reverse rotations of the train of gears and slippages caused by using friction clutches are eliminated, which in turn blocks load fluctuations caused by these transmission mechanisms themselves and load fluctuations accompanied by the operation of the ink sucking means from being transmitted to the sheet feed/discharge means.

Another object of the invention is to provide an ink jet recording apparatus that can increase the degree of freedom in sequencing the entire system of the recording apparatus by allowing the operation of initializing the cleaning means or the ink sucking means to be performed only by rotation of the sheet feed/discharge means in the sheet discharge operation direction, and further by means of allowing the ink sucking means to operate independently of from the location of the carriage.

Another object of the invention is to provide an ink jet recording apparatus having a capping unit that can seal the recording head reliably by means of reducing displacements of the capping unit from the recording head as far as possible.

BRIEF DESCRIPTION OF THE DRAWINGS

FIG. 8(*b*) is a diagram illustrative of a load to be applied when the cap is initially coming into contact with a recording head;

FIG. 8(*c*) is a diagram showing a relationship between the distance between the cap and the recording head and the load applied by the cap to the recording head, the relationship being observed between the cap of the invention and a cap that is located on the centerline inside the cap sealing region and that is held by two springs.

DETAILED DESCRIPTION OF THE INVENTION

Figure 1:
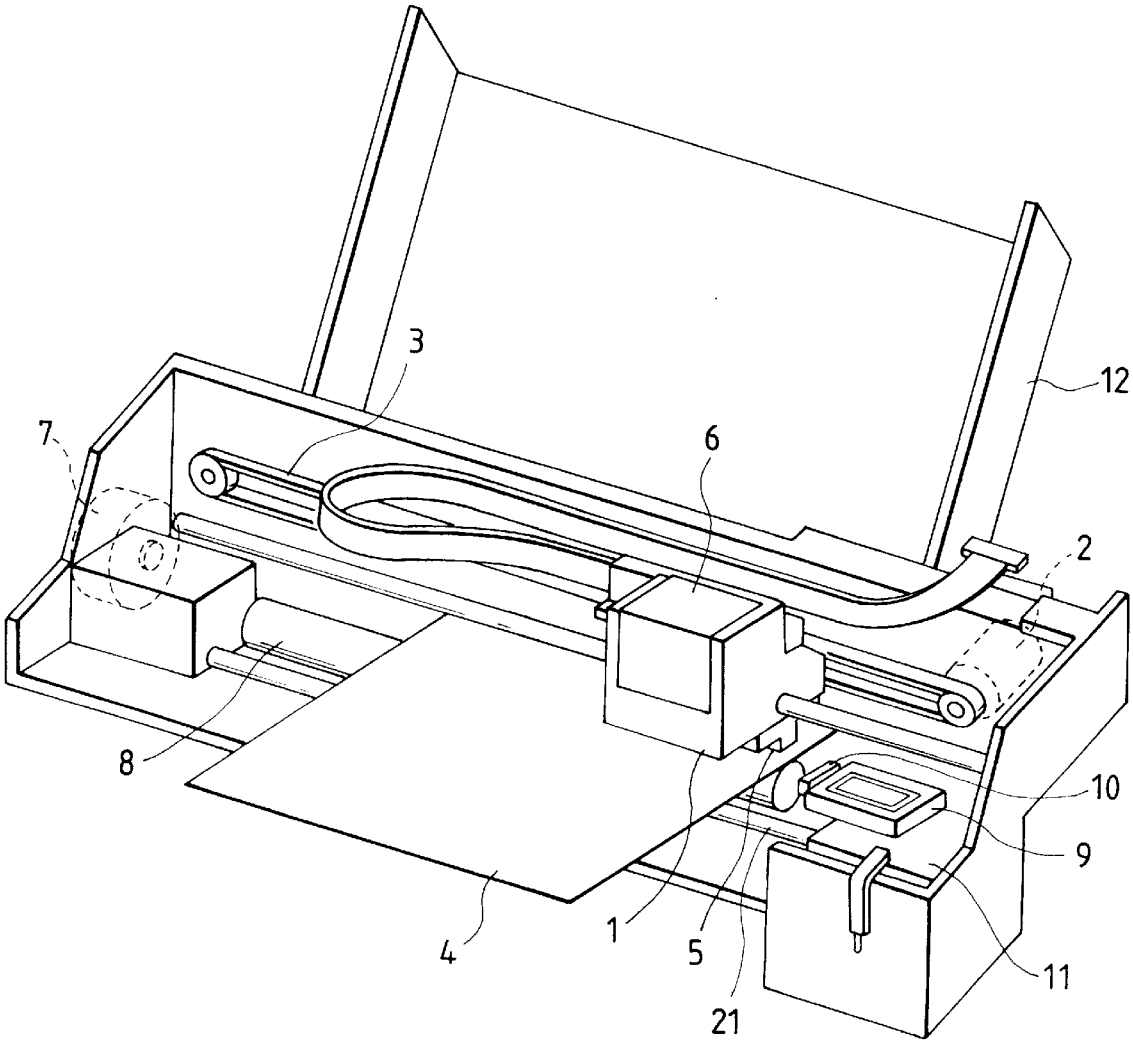
FIG. 1 is a diagram showing an ink jet recording apparatus, which is an embodiment of the invention.

FIG. 1 is a diagram showing an embodiment of the invention. A carriage 1 is connected to a carriage motor 2 through a timing belt 3, and moves to and from across the width of a recording sheet 4. The carriage 1 carries an ink jet recording head 5 on the surface thereof confronting the recording sheet 4, the ink jet recording head 5 serving to jet an ink droplet out of a nozzle opening while causing an actuator to apply pressure to ink. Further, the carriage 1 has an ink cartridge 6 releasably mounted on the upper surface thereof, the ink cartridge 6 serving to supply the ink to the recording head 5. The recording sheet 4 is forwarded in a direction orthogonal to the carriage 1 moving directions at a predetermined pitch by a forward roller 8 that is connected to a sheet forward motor 7 through a drive force transmission mechanism to be described later. Outside a printing region are a capping unit 9 serving to seal the recording head 5 and a cleaner unit 10. The cleaner unit 10 is disposed closer to the printing region than the capping unit 9.

The capping unit 9 has not only the finction of sealing the recording head 5 during nonprinting periods in order to prevent the nozzle openings from clogging, but also the function of forcibly jetting the ink out of the recording head during ink charging periods and during unclogging periods while evacuated to a negative pressure by a pump unit 11. It may be noted that reference numeral 12 denotes a cut sheet feeder.

Figure 2:
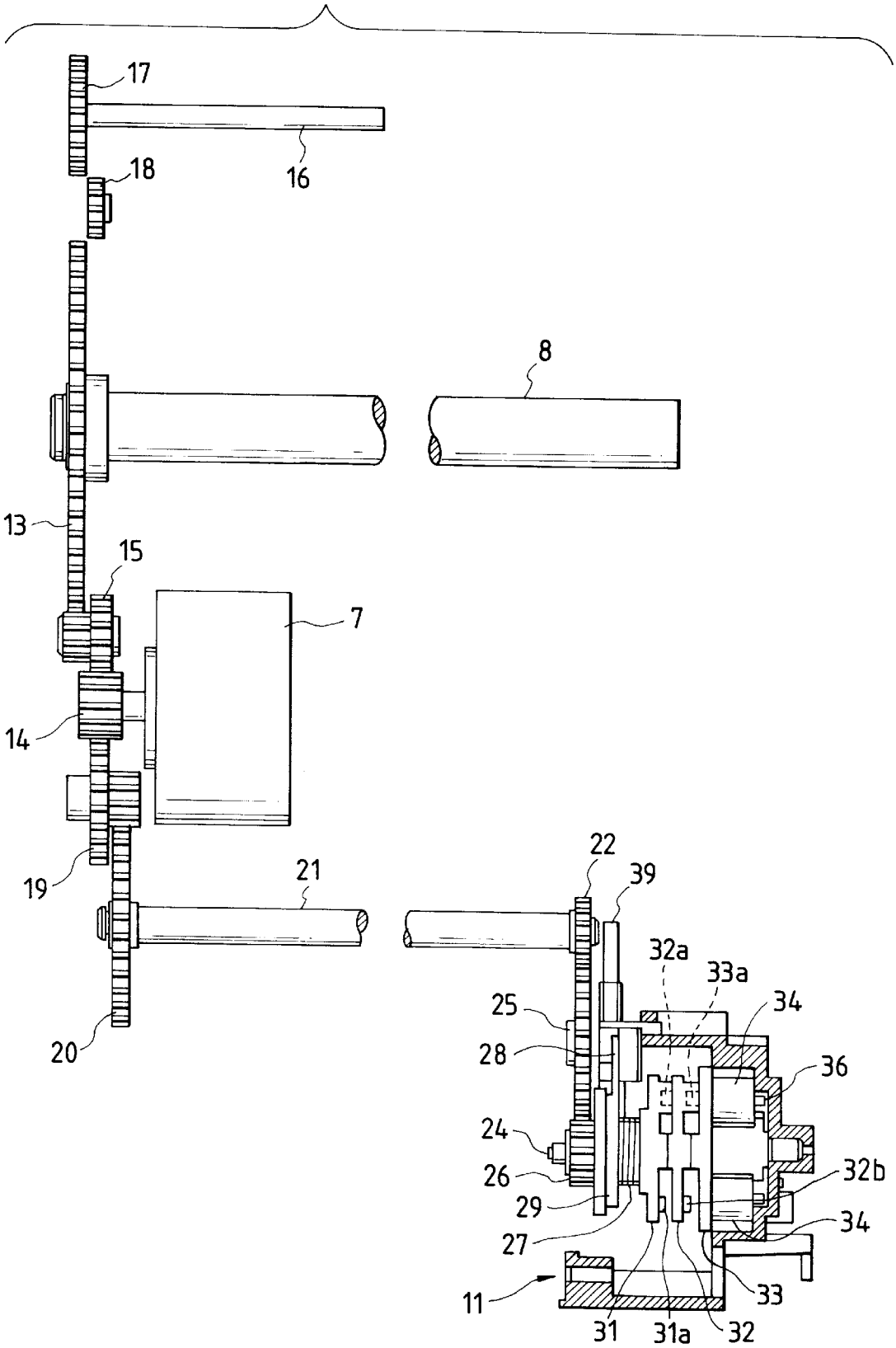
FIG. 2 is a diagram showing a driving power transmitting system of the recording apparatus.
Figure 3:
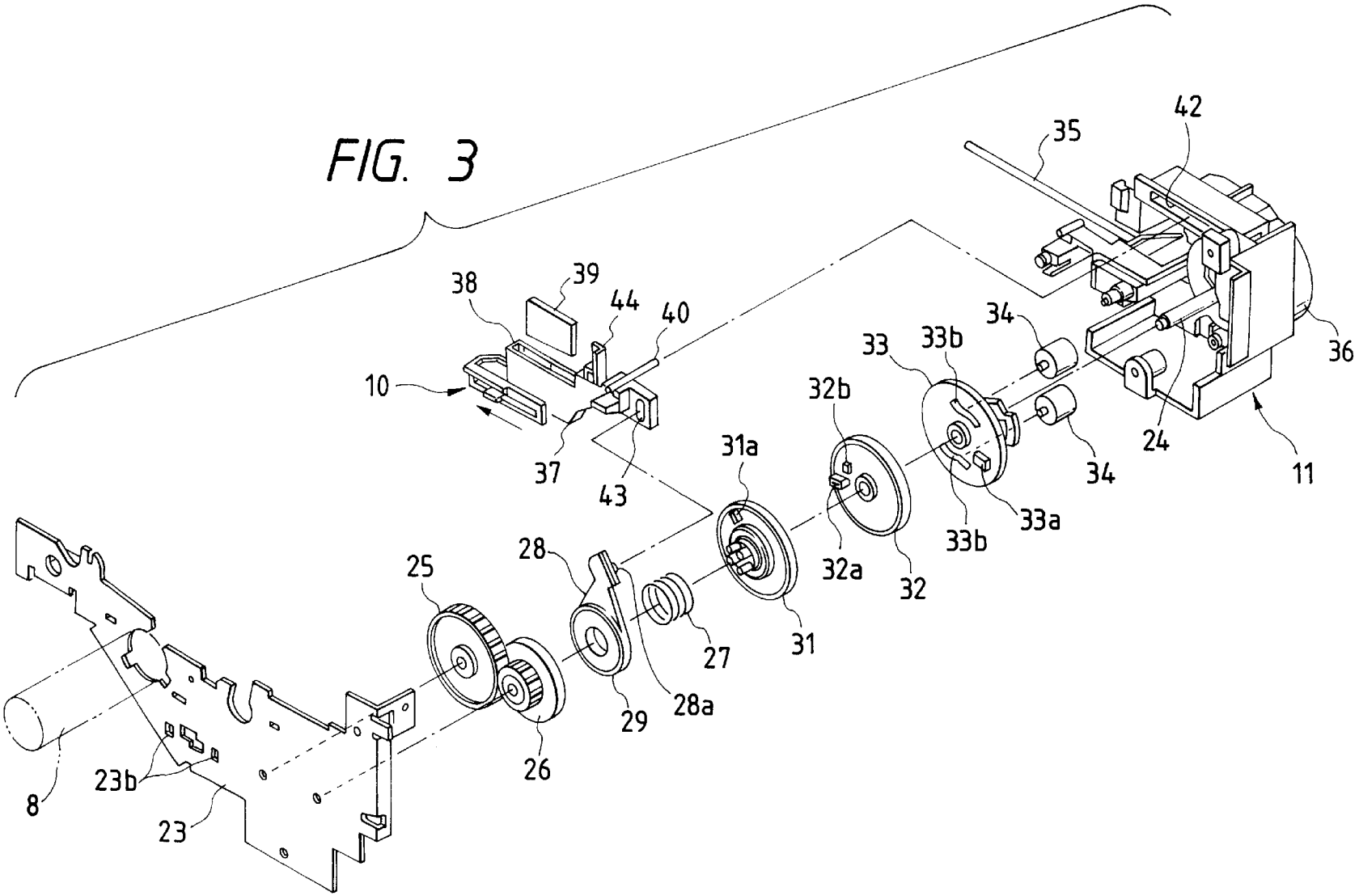
FIG. 3 is an exploded perspective view showing a pump unit in the apparatus.

FIG. 2 and FIG. 3 show an embodiment of the aforementioned drive force transmission mechanism. The forward roller 8 has a gear 13 on one end thereof, and is driven while receiving drive force from a pinion 14 on the shaft of the sheet forward motor 7 through an idler 15. Further, a sheet feed roller drive shaft 16 has a gear 17 on one end thereof, and transmits motive power to the cut sheet feeder 12 while meshed with the gear 13 through a clutch mechanism 18. The pump unit 11 is driven by a gear 22 disposed on one end of a sheet discharge roller 21 while receiving drive force from the pinion 14 of the sheet forward motor 7 through an idler 19 and a sheet discharge roller gear 20. The clutch mechanism 18 is normally kept remote from the gears 13, 17 as shown in FIG. 2 by a not shown spring, and has the gears 13, 17 connected thereto when pressed by the carriage 1.

Then, the construction of various parts and components will be described. The pump unit 11 is attached to a home position side surface of a pump frame 23 that is fixed in a direction orthogonal to the carriage 1 travelling directions. A gear 26 is rotatably disposed on a shaft 24 of the pump unit 11, the gear 26 being meshable with the gear 22 of the sheet discharge roller 21 through an idler 25. The gear 26 has a cleaner cam 29 attached to the back surface thereof so as to be idlably rotatable, the cleaner cam 29 having an arm 28 that frictionally rotates while urged by a spring 27. The cleaner cam 29 moves a cleaner unit 10 with the arm 28 thereof.

Attached to the shaft 24 of the pump unit 11 are a rachet wheel 31, an intermediate transmission wheel 32, and a pump wheel 33, such wheels being placed side by side in such a manner that the intermediate transmission wheel 32 can idlably rotate. The rachet wheel 31 has a projection 31*a* on the surface thereof confronting the intermediate transmission wheel 32. The intermediate transmission wheel 32 has projections 32*a*, 32*b* on both surfaces thereof respectively. The pump wheel 33 has a projection 33*a* on the surface thereof confronting the intermediate transmission wheel 32.

As a result of this construction, even if the rachet wheel 31 starts rotating, the rotation of the rachet wheel 31 is not transmitted to the intermediate transmission wheel 32 until the projection 31*a* of the rachet wheel 31 abuts against the projection 32*a* of the intermediate transmission wheel 32. Further, even if the projection 31*a* of the rachet wheel 31 has abutted against the projection 32*a* of the intermediate transmission wheel 32, the motive power is not transmitted to the pump wheel 33 until the projection 32*b* of the intermediate transmission wheel 32 abuts against the projection 33*a* of the pump wheel 33. That is, upon switchover of the rotational direction of the sheet forward motor 7, there is a rotation transmission lag equivalent to about a maximum of 2 revolutions between the rachet wheel 31 and the pump wheel 33.

The pump wheel 33, as known well, has two shaft holes 33*b*, 33*b*, one end of each shaft hole extending toward the center and the other end extending toward the outer circumference. These shaft holes 33*b*, 33*b* allow rollers 34, 34 that are journaled thereby to move toward the outer circumference or toward the center in accordance with the rotational directions of the pump wheel 33. That is, by rotating the sheet forward motor 7 either forwardly or reversely, pump operation or release operation can be selected, the pump operation applying pressure to a tube 35 with respect to a pump casing 36 and the release operation not applying pressure to the tube 35.

The cleaner unit 10 has a groove 38 formed in the upper surface of a cleaner holder 37 so that a cleaning blade 39 is inserted into such groove 38. The cleaning blade 39 is high enough to allow the distal end thereof to come in resilient contact with a nozzle plate of the recording head 5. The cleaner holder 37 has a guide projection 40 formed on a side portion thereof, and such guide projection 40 is meshed with a guide groove 42 that extends in a direction orthogonal to the carriage 1 moving directions, the guide groove 42 being formed in the upper portion of the pump casing 36. The cleaner holder 37 also has a vertically extending elongated hole 43 in a distal end thereof, and such elongated hole 43 is meshed with a projection 28*a* of the arm 28 of the cleaner cam 29. Further, the cleaner holder 37 has a retaining projection 44 formed thereon between the cleaning blade 39 and the guide projection 40, the retaining projection 44 meshing with a carriage stopper la disposed on a side surface of the carriage 1. As a result of such construction, when the cleaner cam 29 rotates, the guide projection 40 shuttles along the guide groove 42, so that the cleaner unit 10 is moved from an evacuation position to a cleaning position, i.e., from the right end position to the carriage 1 travelling region as viewed in FIG. 1. Then, the cleaning blade 39 comes in resilient contact with the recording head 5, so that the cleaning blade 39 not only wipes the nozzle surface, but also blocks a cap 80 to be described later from moving toward a start end.

Figure 4A:
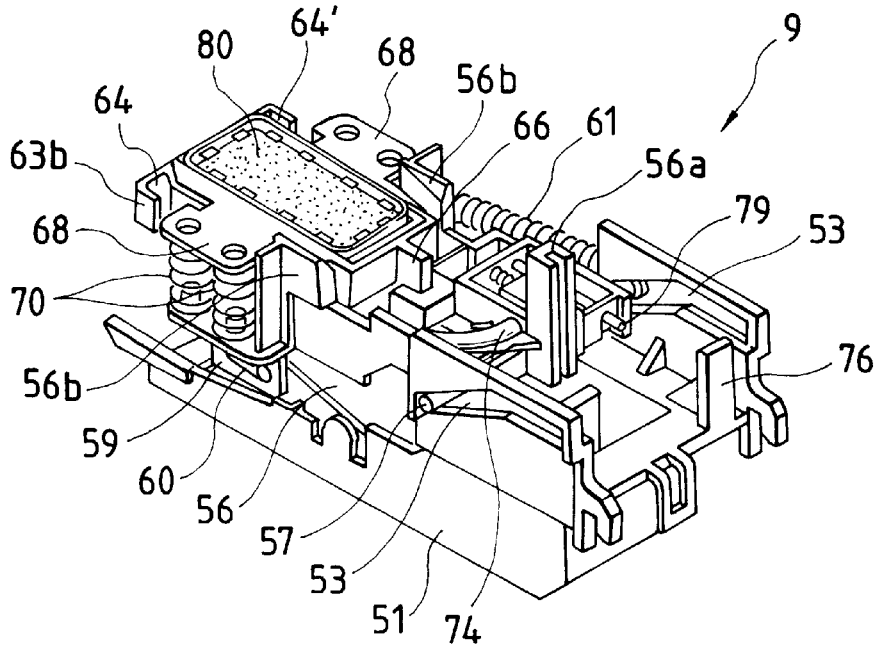
FIGS. 4(*a*) and 4(*b*) are perspective views showing an embodiment of a capping unit to be used in the apparatus as viewed from both sides, respectively.
Figure 4B:
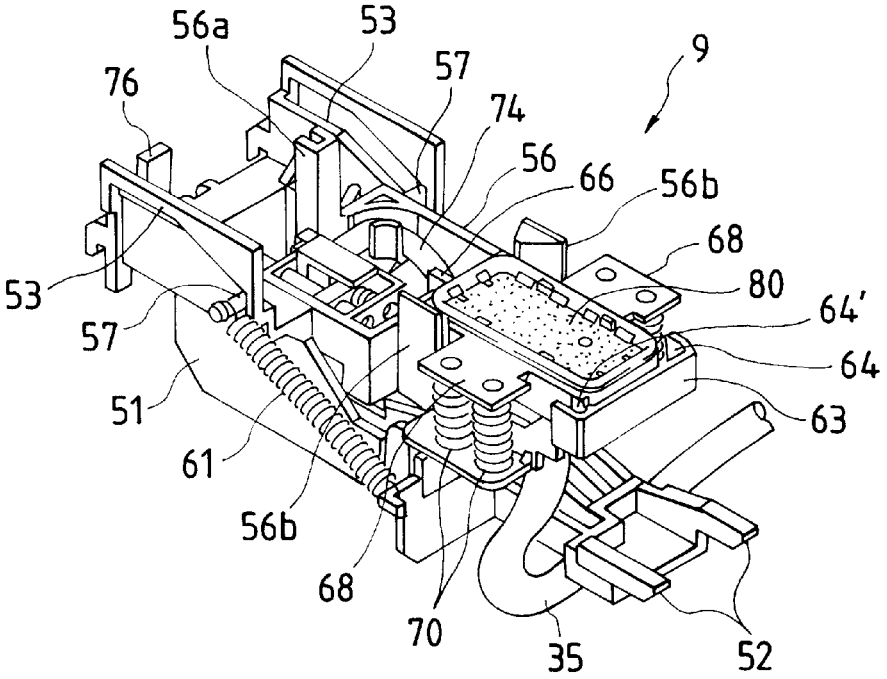
Figure 5:
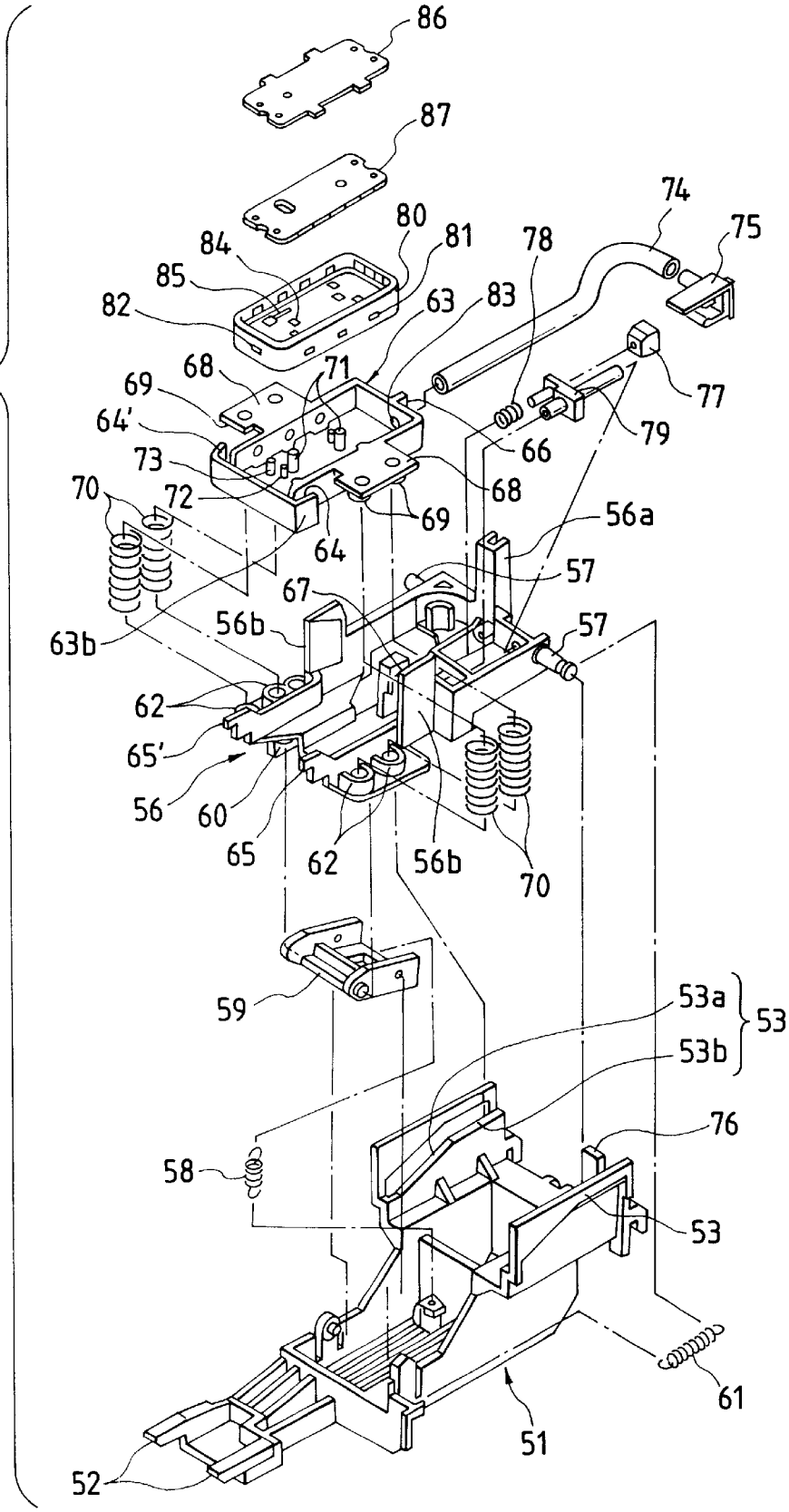
FIG. 5 is an exploded perspective view showing the embodiment of the capping unit to be used in the apparatus.

FIG. 4 and FIG. 5 show an embodiment of the capping unit 9. A cap frame 51 is attached to the pump frame 23 with two retaining projections 52, 52, which project from one end thereof, meshed with retaining holes 23*b*, 23*b* of the pump frame 23, so that the longitudinal direction of the cap frame 51 extends in the carriage 1 travelling directions. The cap frame 51 has cam grooves 53, 53 arranged on both sides thereof. Each cam groove 53, consisting of an upwardly sloped portion 53*a* and a horizontal portion 53*b*, extends from the start end portion side to the termination end portion side of the home position, i.e., from the left to the right as viewed in FIG. 5. Projections 57 of a slider 56 are sidably attached to these cam grooves 53, 53.

Figure 6A:
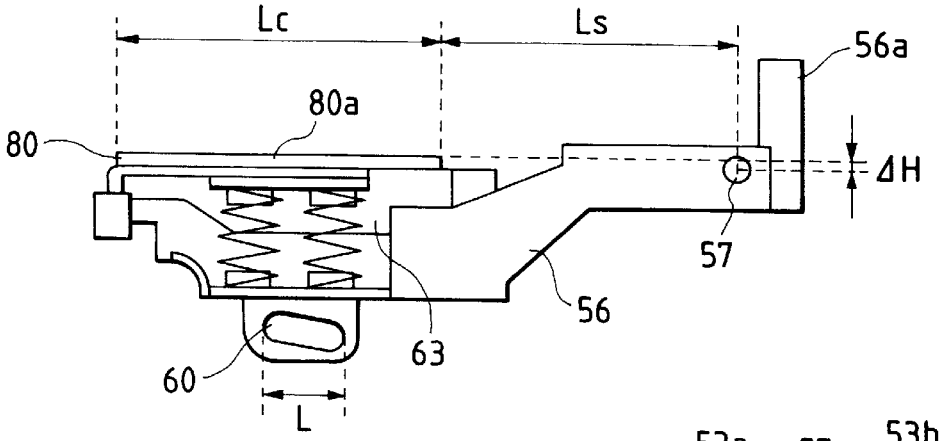
FIGS. 6(*a*) to 6(*c*) are diagrams illustrative of the size of a slider and a cap frame and of the amounts of displacement caused at the time of capping, respectively.
Figure 6B:
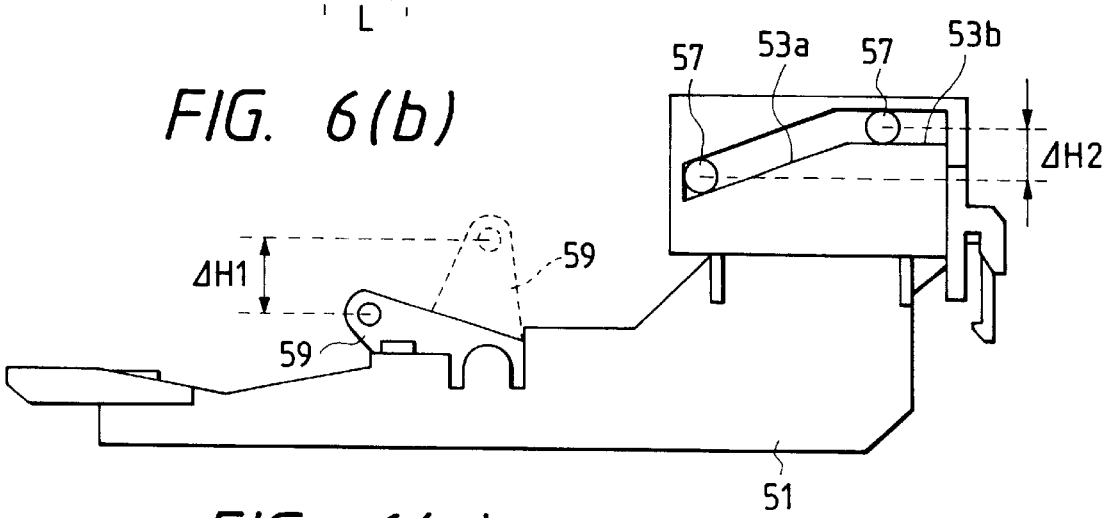
Figure 6C:
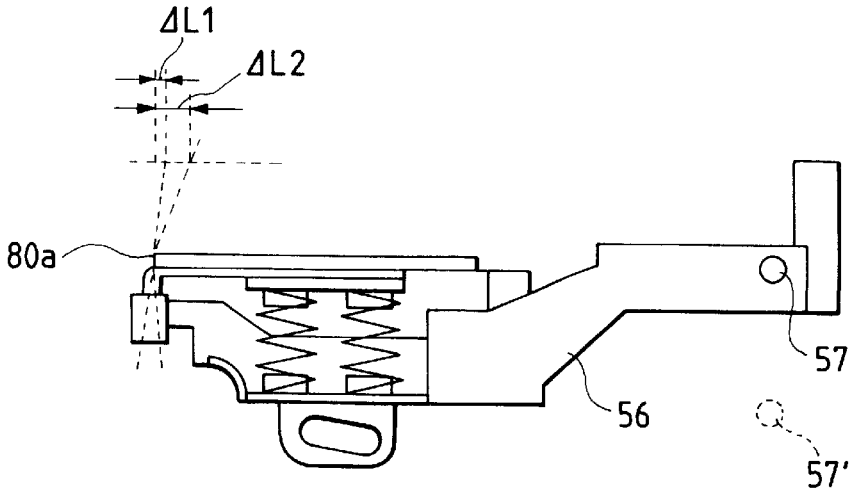
Figure 7A:
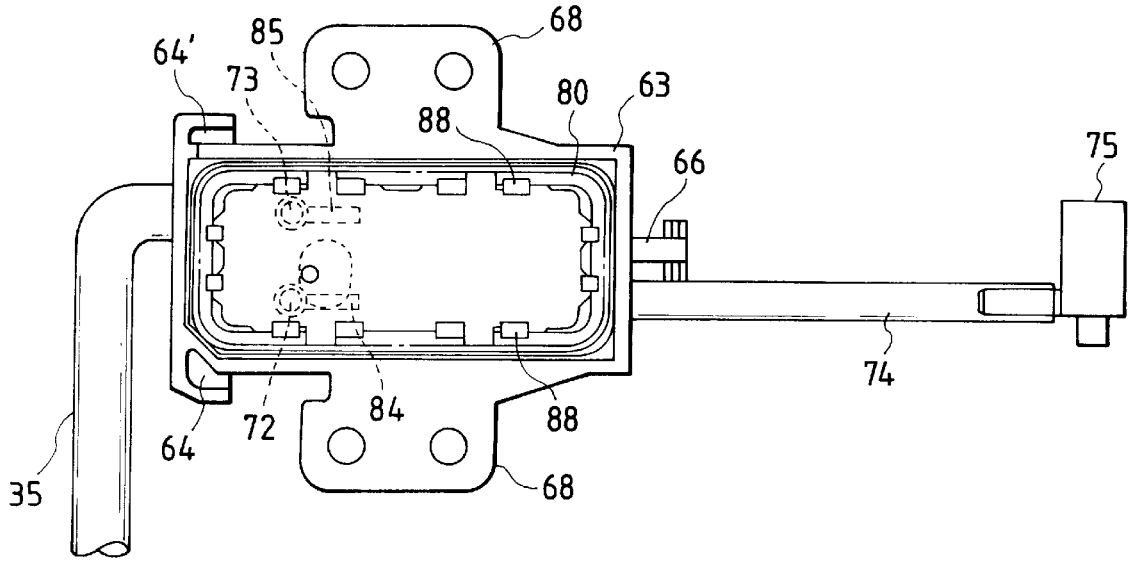
FIGS. 7(*a*) to 7(*c*) are a top view of an embodiment of a cap holder with a cap attached thereto, a sectional view thereof with the cap removed therefrom; and a sectional view of an embodiment of the cap.
Figure 7B:
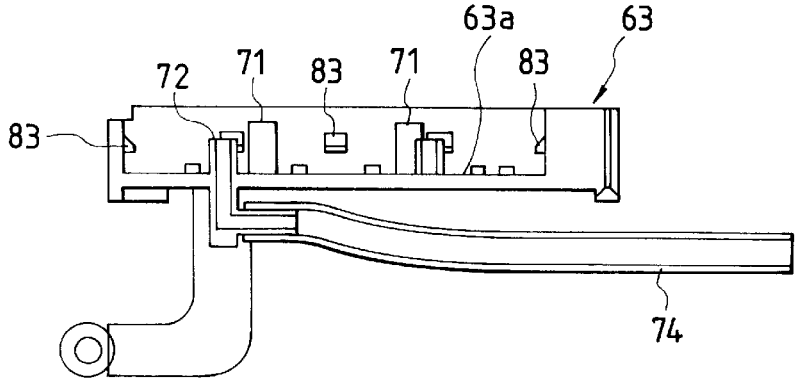
Figure 7C:
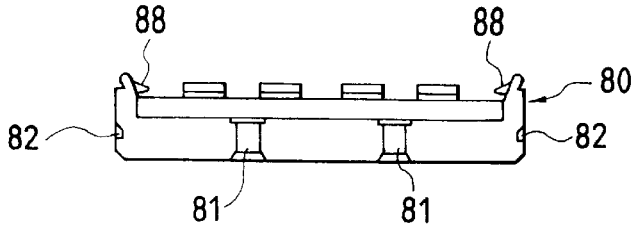

The slider 56 not only has, on the termination end portion side thereof, a contact piece 56*a* that comes in contact with the carriage 1, but also has a holder receiving portion formed at a location that is apart from the contact piece 56*a* by a distance Ls as shown in FIG. 6(*a*), the holder receiving portion serving to support the cap 80. The distance Ls is equal to a length Lc that is the longitudinal length of the cap 80. The slider 56 has, on both sides thereof, guide pieces 56*b*, 56*b* that guide the recording head 5. The slider 56 also has the termination end portion side thereof supported with the projections 57 thereof attached to the cam grooves 53 of the cap frame 51, and has the start end portion side thereof held by a lever 59 constituting a link that is rotatably urged toward the termination end portion side by a spring 58.

As shown in FIG. 6(*a*), each projection 57 is formed at a location substantially flush with a sealing surface 80*a* of the cap 80 ($\Delta H \approx 0$). As a result of this construction, the displacement $\Delta L1$ can be minimized, $\Delta L1$ being the horizontal displacement resulting from the slider 56 rotating about the projections 57 at the time of sealing the recording head 5 after having moved to the capping position. Unlike this construction, if the projection 57 is formed at a different location (57'), higher or lower, a larger displacement $\Delta L2$ results, thereby making it more difficult to provide reliable sealing.

Further, the lever 59 that supports the lower portion of the slider 56 is designed as shown in FIG. 6(*b*) so that the length of the arm provides a lift $\Delta H1$ which is greater than the lift $\Delta H2$ provide by the sloped portions 53*a* of the cam grooves 53. It may be noted that loads to be applied during capping can be reduced by making the sloped portions 53*a* more horizontal. As a result, by reducing impact to the carriage 1 while reducing the current for driving the carriage motor 2, trouble such as missing dots caused by the recording head 5 breaking the meniscuses is prevented. Therefore, printing reliability can be ensured. Further, the length of the lever 59 can be reduced by an amount corresponding to the reduced loads to be applied during capping, so that the horizontal displacement of the slider 56 which is determined by the distance rotated by the lever 59 can be restricted. As a result, the overall size of the capping unit can be reduced.

The slider 56 meshes with the distal end of the lever 59 through a meshing hole 60 that has a length L and that is formed in the lower portion thereof That is, the slider 56 is coupled to the lever 59 with a degree of freedom equivalent to the length L of the meshing hole 60 (FIG. 6(*a*)), so that the slider 56 can be drawn toward the start end portion side, i.e., the lower end portion side of the sloped portions 53*a* while maintaining the uncapped condition. As a result, wherein the uncapped condition, a stopper surface 63*b* of the cap holder 63 is displaced to a region confronting the front end face of the cleaner unit 10 by moving the lowest level region of the slider 56 up to such a location as to overlap the cleaner unit 10 operating region, which in turn prevents the cleaner unit 10 from projecting into the carriage 1 moving region. As a result, the capping unit 9 can be disposed as close to the recording sheet 4 side of the carriage 1 moving path as possible, i.e., without providing a large safety tolerance. Hence, the width of the recording apparatus can be reduced.

The slider 56 has spring receiving seats 62, 62 formed on the upper surface thereof. The spring receiving seats 62, 62 are scattered on left and right sides of the slider 56 so as to be symmetrical about the centerlines extending along the length and across the width of the cap 80, and scattered in the carriage 1 moving direction. The slider 56 also has projections 65, 65' formed on both sides of the start end portion side thereof, the projections 65, 65' being meshable with grooves 64, 64' of the cap holder 63. Further, the slider 56 has a groove 67 formed along the longitudinal centerline on the termination end portion side thereof, the groove 67 being meshable with a projection 66 of the cap holder 63.

The cap holder 63 has spring receiving portions 68, 68 that project from both sides thereof. It is in these spring receiving portions 68, 68 that spring receiving seats 69, 69 are arranged so as to be scattered in the carriage 1 moving directions. The cap holder 63 also has the grooves 64, 64' formed on both sides of the start end portion side thereof, the grooves 64, 64' being meshable with the projections 65, 65' of the holder 56. Further, the cap holder 63 has the projection 66 formed along the longitudinal centerline on the termination end portion side thereof, the projection 66 being meshable with the groove 67 of the slider 56. The bottom surface of one of the grooves 64, 64' is slightly higher than that of the other groove 64, 64' or the bottom surface one of the projections 65, 65' is slightly higher than that of the other projection 65, 65'. As a result, the cap holder 63 is supported at three points so as to allow one side of the start end portion side thereof to take a slightly lower position with respect to the slider 56. Accordingly, the grooves 64, 64' of the cap holder 63 mesh with the projections 65, 65' of the slider 56, with the projection 66 of the cap holder 63 meshes with the groove 67 of the slider 56, and compression springs 70 are interposed between the respective spring receiving portions 62, 69 so that the cap holder 63 is urged upward. Specifically, the cap holder 63 is set so that one side of the cap holder 63 is at least lmm lower with respect to the slider 56, or one side of the cap holder 63 is inclined with respect to the nozzle surface of the recording head 5 at an angle of 2 degrees or more.

Further, since the cap holder 63 is supported at the three points, the positioning height of the sealing surface of the cap 80 that is accommodated in the cap holder 63 can be adjusted more correctly. Further, the cap 80 can be easily removed from the recording head 5 by applying a peeling force to the cap holder 63 with a point outside the cap 80 as a fulcrum since the moment of the force is large, the cap 80 is easily removed, even when stuck to the recording head 5 due to solidification of the ink or the like. It must be appreciate that the cap holder 63 is resiliently urged toward the recording head 5 by the compression sprigs 70 which are located to the outside of the sealing region. Therefore, assuming that the compression forces to be applied by the compression springs 70 are Pa, Pb; the distances from the springs 70 to the cap 80 sealing points are La, Lb; and the distance between the sealing points, i.e., the width of the cap 80 is W, the reaction forces Ra, Rb at the respective sealing points are given as follows:

$Ra=\{Pa\ (W+La)-Pb\cdot Lb\}/W$; and $Rb=\{Pb\ (W+Lb)-Pa\cdot La\}/W$.

Then, in order to allow the cap 80 to be in uniform contact with the recording head 5, the reaction forces Ra, Rb applied to the respective sealing points must be identical to each other. Therefore, the conditions;

$\{Pa\ (W+La)-Pb\cdot Lb\}=\{Pb\ (W+Lb)-Pa\cdot La\}$; and $Pa\ (W+2La)=Pb\ (W+2Lb)$.

that is, $Pa=Pb$; and $La=Lb$, must be satisfied.

To satisfy the above conditions, the compression springs 70 having similar elastic properties are used on both sides, and these springs 70 are laid out so as to be symmetrical with respect to the cap 80.

On the other hand, since the cap holder 63 is positioned with one side of the start end portion side being slightly lower than the other side, there is a disequilibrium in the loads to be applied when the cap 80 comes into contact with the recording head 5.

Figure 8A:
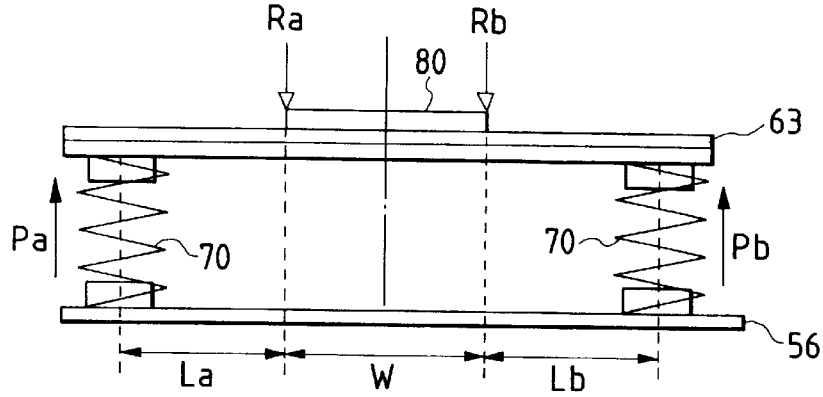
FIG. 8(*a*) is a diagram illustrative of a load to be applied to the cap.
Figure 8B:
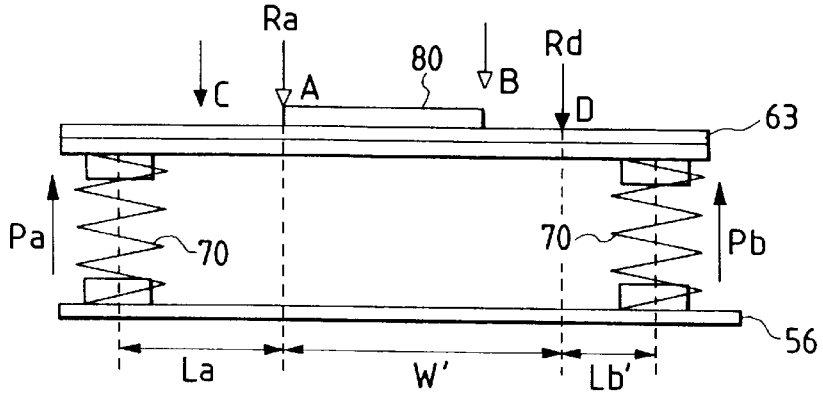
Figure 8C:
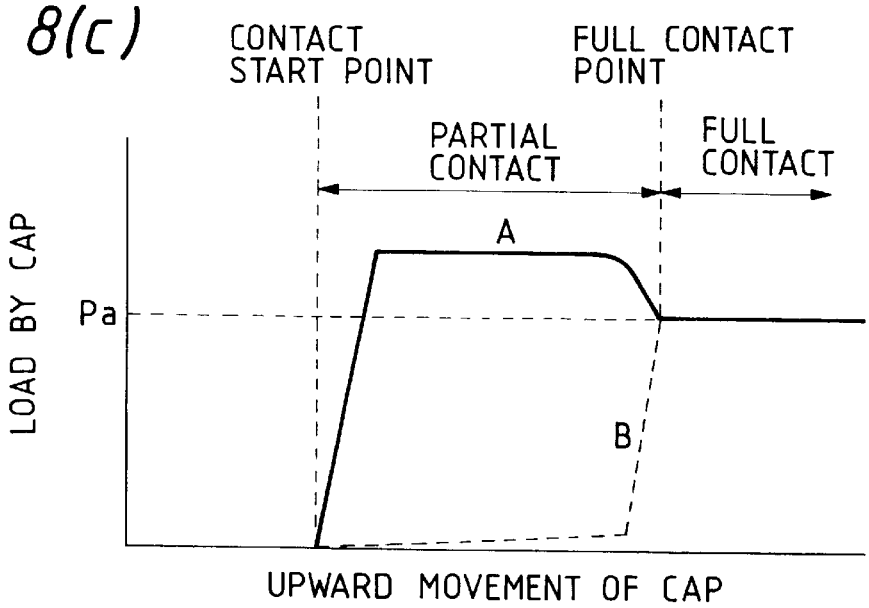

As shown in FIG. 8(*b*), reaction forces Ra, Rd at the support points A, D are given, respectively, as follows.

$Ra=\{Pa\ (W'+La)-Pb\cdot Lb'\}/W'$; and $Rd=\{Pb\ (W'+Lb')-Pa\cdot La\}/W'$.

Then, since the loads Pa, Pb are set to the same value as described above, $Ra=Pa+\{Pa\ (La-Lb')\}/W'$; and $Rd=Pa+\{Pa\ (Lb'-La)\}/W'$.

Further, since $La>Lb'$, it is axiomatic that $\{Pa\ (La-Lb')\}/W'>0$.

Hence, $Ra=Pa+\{Pa\ (La-Lb')\}/W'>Pa$

When the cap 80 comes into contact with the recording head 5, a load that is larger by $\{Pa\ (La-Lb')\}/W'$ than the load Pa to be applied by the springs 70 themselves is applied to each contact point. As a result, self-aligning properties and contacting properties are increased. Although it is proposed to set W' and Lb' to smaller values and La to a larger value in order to increase the incremented load $\{Pa\ (La-Lb')\}/W'$ to be applied at the initial stage of contact, it is more realistic to set La to a larger value and Lb' to a smaller value since W' depends on the size of the cap 80.

FIG. 8(*c*) shows a relationship between the distance between the cap and the recording head and the load to be applied by the cap to the recording head, the relationship being observed between the cap of the invention and a conventional cap that is held by two springs located along a centerline inside the cap sealing region. The cap of the invention whose characteristics are indicated by the solid line A can ensure that an adequate load can be given at the initial stage of contact, whereas the conventional cap whose characteristics are indicated by the dashed line B indicates that the full contact load is applied for the first time only immediately before the cap fully contacts the recording head.

The cap holder 63 has two projections 71 erected along the longitudinal centerline of the bottom surface 63*a* thereof, and two cylindrical bodies 72, 73 formed on the start end portion side thereof so as to be symmetrical about the longitudinal centerline. The cylindrical body 73 is connected to the tube 35 of the pump unit 11 while vertically extended to the outside. The cylindrical body 72 is connected to a valve seat 75 (described later) through a tube 74 while extended to the outside, the tube 74 extending in parallel to the bottom surface and bent toward the termination end portion side. Since the tubes 35, 74 are attached to the cap holders 64 at locations which are as close to the longitudinal centerline of the cap 80 as possible and are disposed vertically with respect to the cap and parallel to the moving direction of the cap, the bending moment to be applied to the cap 80 is advantageously reduced as much.

The valve seat 75 is fixed to the termination end portion of the slider 56, and has a valve 77 fixed thereto. An operation rod 79 is attached to the slider 56 not only in such a manner as to be sidable in the carriage moving directions while coming in contact with a contact piece 76 disposed on the cap frame 51, but also at a location confronting the valve 77 so that the valve 77 can maintain the closed position at all times while urged by a spring 78.

The cap holder 63 holds the cap 80 therein with recesses 81, 82, projections 71, and claws 83 formed in and on the cap 80. The cap is made of an elastic member such as rubber having ink resistance. The cap 80 has recesses 84, 85 formed in the bottom surface thereof, the recesses 84, 85 communicating with the cylindrical bodies 72, 73, and holds two ink absorbing sheets 86, 87 with claws 83. The ink absorbing sheets 86, 87 are made of a porous material having ink resistance.

Figure 9:
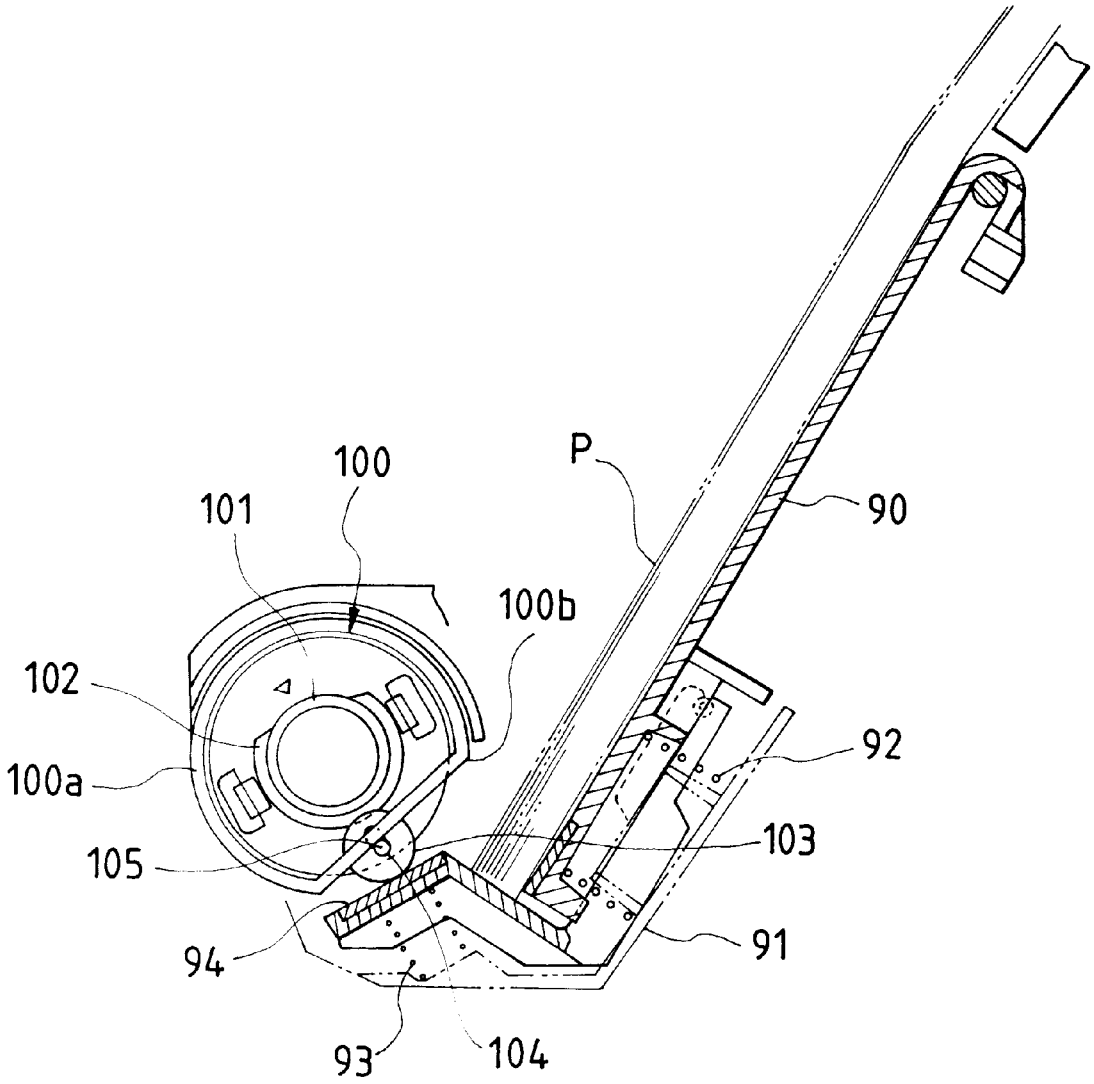
FIG. 9 is a sectional view showing an embodiment of a sheet feed mechanism of a cut sheet feeder.

FIG. 9 shows an embodiment of the cut sheet feeder 12 in the form of a cut sheet mechanism. The cut sheet feeder 12 includes a hopper 90, a separation pad 94, and a sheet feed roller 100. The hopper 90 has the lower back surface thereof urged toward the sheet feed roller by a spring 92 that is interposed between a frame 91 and itself. Further, the separation pad 94 that is urged in a normal direction of the sheet feed roller 100 by a spring 93 is disposed on a lower hopper surface confronting the sheet feed roller 100. The separation pad 94 is moved up and down by a cam (not shown) so as to be interlocked with the sheet feed operation while the sheet feed roller 100 is making a single revolution, the cam being disposed on the sheet feed roller drive shaft 16.

The sheet feed roller 100 has an arcuate portion 100*a* and a straight portion 100*b*, and is therefore D-shaped in cross section so that a high frictional force can be caused with respect to a recording sheet. The sheet feed roller 100 is attached to the sheet feed roller drive shaft 16 through a bushing 101, and makes a single revolution during sheet feed operation while driven by the sheet forward motor 7 through the gear 17. The bushing 101 has a cam surface 102 formed thereon so that the cam surface 102 extends around the central shaft excluding a bushing 101 region opposite to the straight portion 100*b* of the sheet feed roller 100. The cam surface 102 allows an idle roller 103 to move therethrough. The idle roller 103 is rotatably held by a shaft 105 that is movable within an elongated hole 104 in the frame 91, and is attached so as to be vertically movable with respect to the separation pad 94.

As a result of such construction, when the sheet feed roller 100 reversely rotates (counterclockwise in FIG. 9) through a predetermined angle, the separation pad 94 is separated from the sheet feed roller 100 by a cam mechanism (not shown), and the recording sheet is bounced back to the hopper 90 by a not shown sheet return lever (not shown). Substantially simultaneously with the returning of the recording sheet to the hopper 90, the separation pad 94 is pressed onto the sheet feed roller 100. Then, when the sheet feed roller 100 rotates clockwise, the hopper 90 is instantaneously pushed up by the spring 92, and sheets P are also pushed up, so that the arcuate portion 100*a* of the sheet feed roller 100 is pressed against the uppermost sheet. As the sheet feed roller 100 continues to rotate, such uppermost sheet is fed toward the separation pad 94. By threading the recording sheet between the separation pad 94 and the sheet feed roller 100 through rotation of the arcuate portion 100*a*, a single sheet is separated by the separation pad 94 out of a plurality of recording sheets, and the separated sheet is further forwarded to the forward roller 8. At this point in time, the arcuate portion 100*a* of the sheet feed roller 100 has passed through the separation pad 94 and the straight portion 100*b* confronts the separation pad 94. Therefore, it is the idle roller 103 pressed against the cam surface 102 that pushes the recording sheet onto the separation pad 94, which in turn prevents a plurality of unseparated recording sheets from being forwarded to the forward roller 8 superfluously. Then, when the sheet feed roller 100 makes another revolution, the sheet feed mechanism is reset to the original condition, and therefore ready for next sheet feed operation.

A description of the operation of the apparatus according to the present invention follows.

Figure 10A:
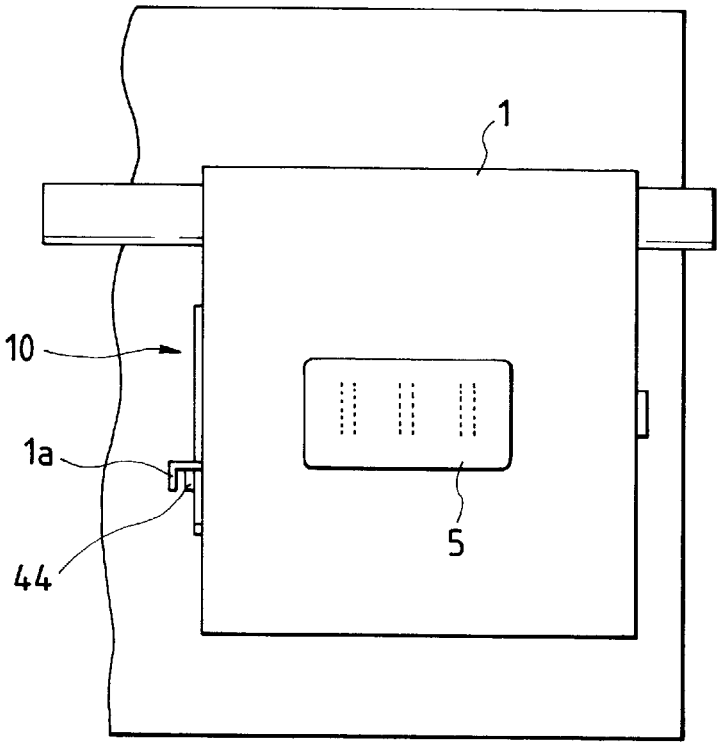
FIGS. 10(*a*) and 10(*b*) are a plan view and a side view respectively showing a condition in which a carriage is locked by a cleaner unit out of operations of the cleaner unit and the capping unit.
Figure 10B:
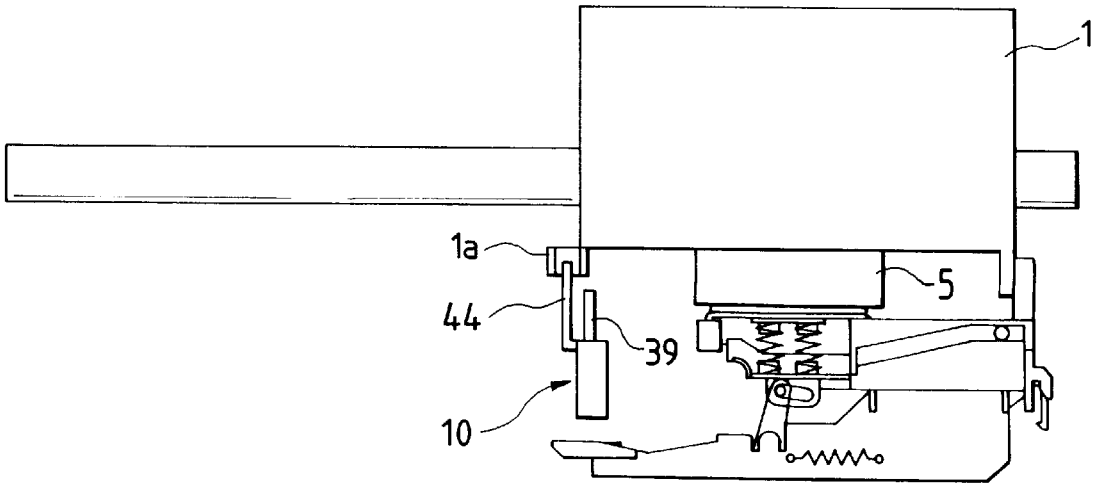
Figure 11A:
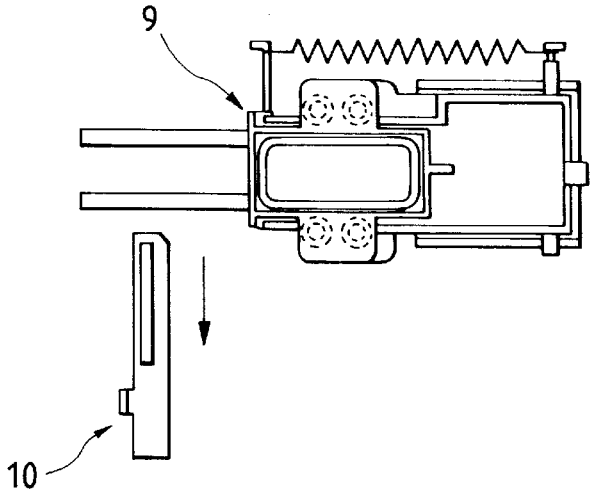
FIGS. 11(*a*) and 11(*b*) are a plan view and a side view respectively showing a condition in which the carriage is unlocked out of the operations of the cleaner unit and the capping unit.
Figure 11B:
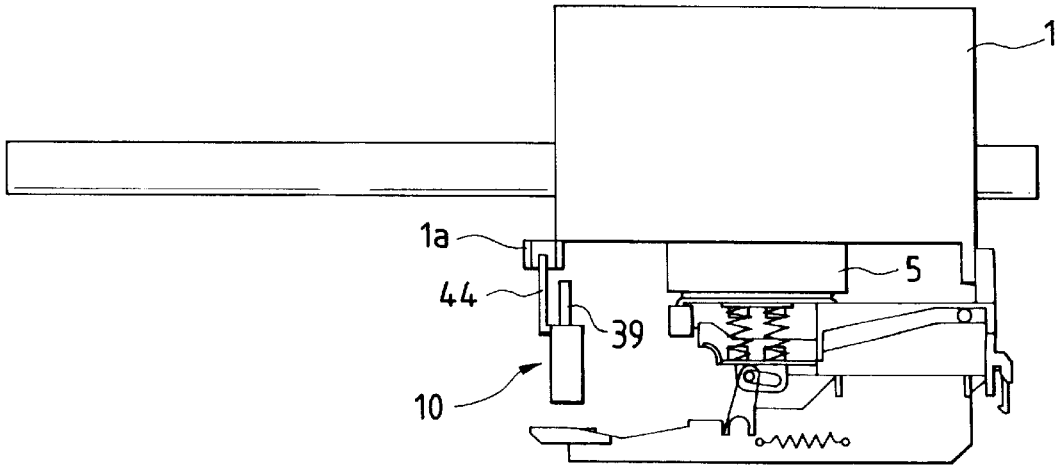
Figure 12A:
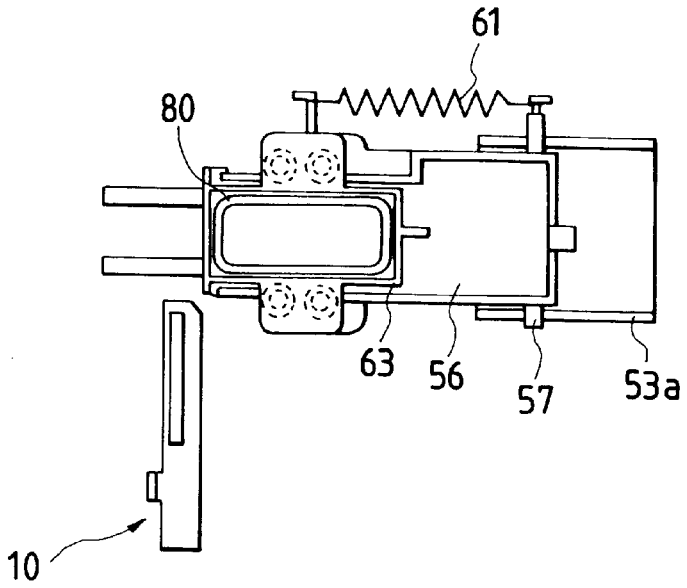
FIGS. 12(*a*) and 12(*b*) are a plan view and a side view respectively showing a flushing condition out of the operations of the cleaner unit and the capping unit.
Figure 12B:
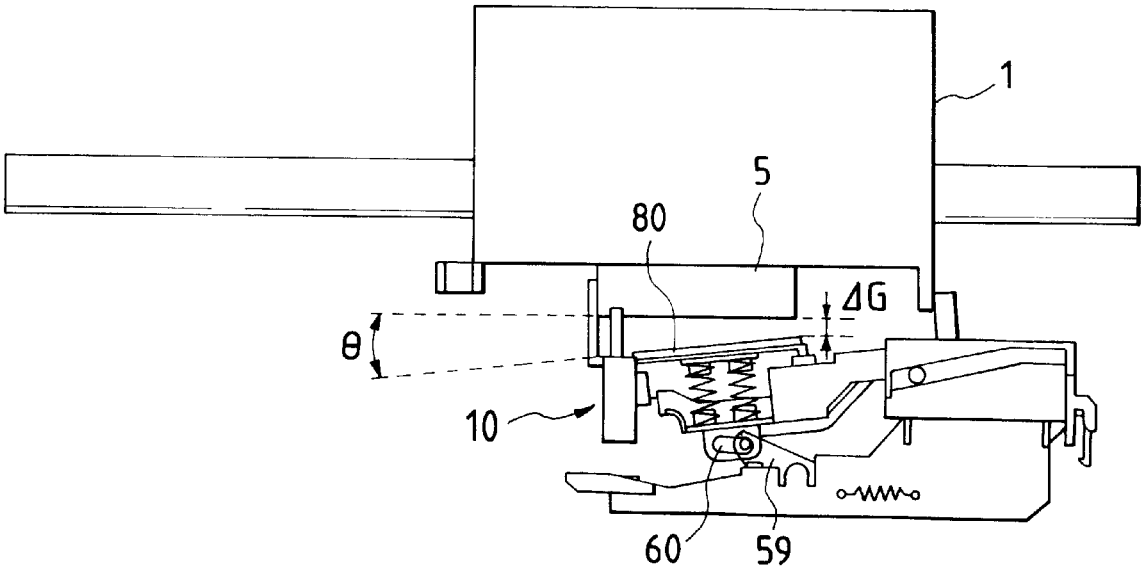

During stoppage, the carriage 1 is locked with the retaining projection 44 of the cleaner unit 10 by pressing with the carriage stopper 1*a* as shown in FIG. 10. Therefore, the sheet forward motor 7 is rotated forwardly to thereby evacuate the cleaner unit 10 from the recording head 5 and unlock the carriage as shown in FIG. 11 (S100). As a result, the carriage 1 is movable, so that the carriage 1 is moved slightly toward the start end portion to thereby form a gap $\Delta G$ between the recording head 5 and the cap 80 as shown in FIG. 12 (S101), and a flushing signal is supplied to the recording head 5 under this condition to thereby jet ink droplets onto the cap 80 out of nozzles (S102). Since the cap 80 surface is inclined by an angle $\theta$ with respect to the nozzle surface of the recording head 5 under this condition, the possibility that ink splashes bounced back from the ink absorbing sheet 86 will deposit on the nozzle surface is significantly reduced. Since the slight movement of the carriage toward an end of the sheet is contained within the length L of the meshing hole 60 of the lever 59, the lever 59 remains inoperative. Therefore, even if the carriage 1 comes into contact with the slider 56, the resulting shock applied to the carriage 1 is absorbed, which in turn prevents the recording head 5 from damaging the meniscuses and hence ensures reliable printing operations.

Then, by moving the carriage 1 to the end portion confronting the home position, the gear 13 is meshed with the gear 17 of the sheet feed roller drive shaft 16 by the clutch mechanism 18 (S103), and the sheet forward motor 7 is rotated reversely slightly to thereby cause the cut sheet feeder 12 to perform the sheet return operation (S104). The drive force from the rachet wheel 31 is not transmitted to the pump wheel 33 since there is a transmission delay between the rachet wheel 31 and the intermediate transmission wheel 32. Therefore, the cut sheet feeder 12 can perform the sheet return operation without applying unnecessary loads to the sheet forward motor 7. Then, when the sheet forward motor 7 is rotated forwardly, the sheet feed roller 100 is rotated forwardly to thereby feed a recording sheet to the nipping region of the forward roller 8 (S105).

Then, by moving the carriage 1 toward the home position, the gear 13 is unmeshed from the gear 17 of the sheet feed roller drive shaft 16 by the clutch mechanism 18 (S106), and the sheet forward motor 7 is rotated reversely and the sheet is paid out of the forward roller 8 to thereby eliminate a skew of the recording sheet (S107).

By moving the carriage 1 to the position at which the clutch mechanism 18 can perform the meshing operation, the gear 13 is meshed with the gear 17 of the sheet feed roller drive shaft 16 (S108), and the sheet forward motor 7 is rotated forwardly to thereby forward the recording sheet to the forward roller 8, and the cut sheet feeder 12 is reset (S109). Then, by moving the carriage 1 toward the home position to thereby cause the clutch mechanism 18 to release the meshing of the gear 13 with the gear 17 of the sheet feed roller drive shaft 16 (S110), and the sheet forward motor 7 is rotated reversely to thereby cause the forward roller 8 to locate the head end of the sheet to a predetermined position (S111), and further the sheet forward motor 7 is rotated forwardly to thereby perform sheet positioning and backlash eliminating operations (S112), and printing operation is thereafter started (S113). Since forward and reverse rotations of the sheet forward motor 7 in these operations are made only slightly and alternately, a transmission delay caused by the intermediate transmission wheel 32 keeps the pump unit 11 inoperative. As a result, it is only loads necessary to forward the sheet that is applied to the sheet forward motor 7.

When the printing operation has been started with the sheet thus set, the sheet forward motor 7 rotates forwardly to forward the sheet by a distance equivalent to a single line every time the recording head 5 ends printing a single line of data. Although there is no transmission delay caused by the intermediate transmission wheel 32 because of the successive forward rotation of the sheet forward motor 7, the pump unit 11 rotates with the rollers 34 which are drawn toward the center. Therefore, the pump unit 11 does not function as a pump, so that there is no likelihood that the pump unit 11 will apply unnecessary loads to the sheet forward motor 7.

Figure 13A:
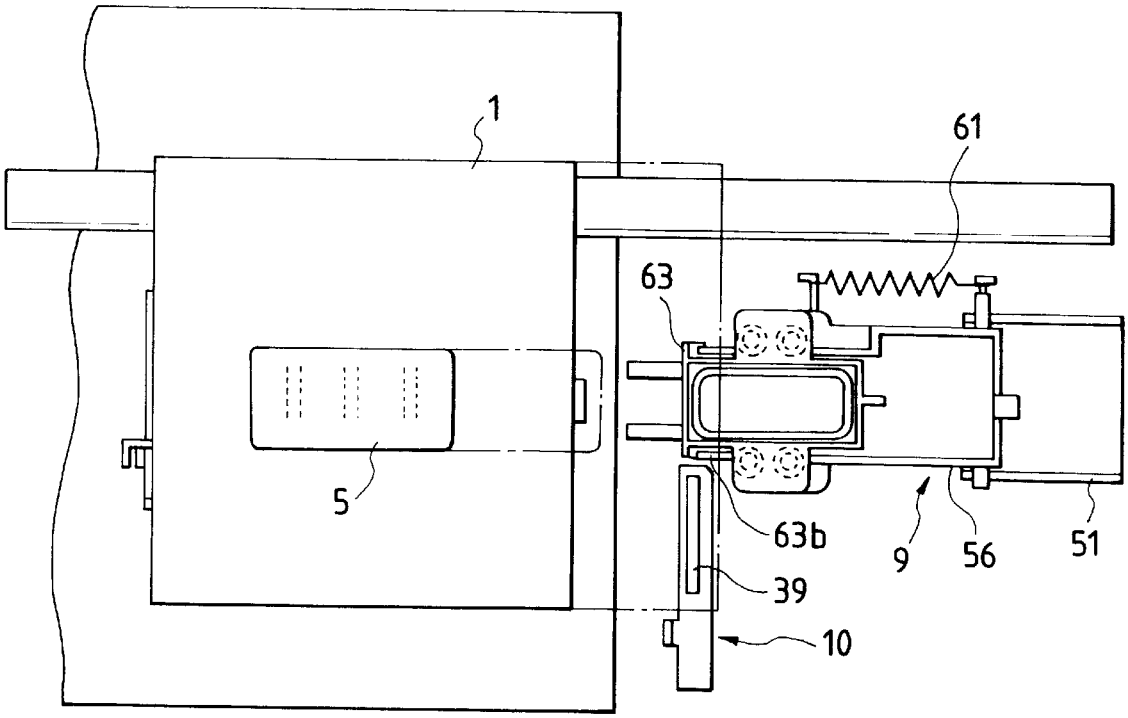
FIGS. 13(*a*) and 13(*b*) are a plan view and a side view respectively showing a condition in which the cleaner unit is locked out of the operations of the cleaner unit and the capping unit.
Figure 13B:
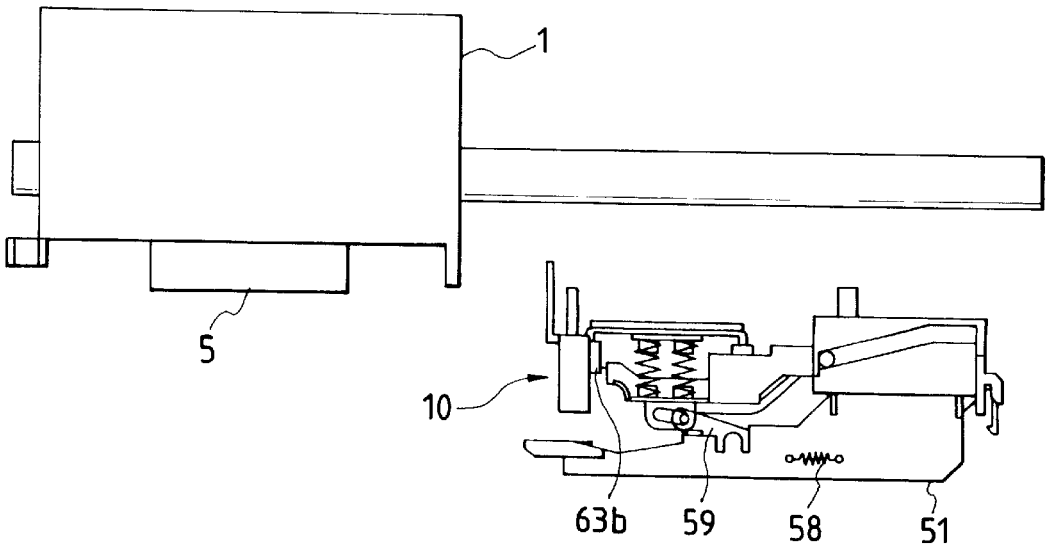

While the recording head 5 is printing with the sheet forward motor 7 rotating forwardly and with the carriage 1 moving to and from within the printing region, not only the cleaner unit 10 in the reset position, i.e., in the evacuated position, which is out of the recording head 5 travelling region as shown in FIG. 13, but also the slider 56 of the capping unit 9 is lowered by the lever 59 that is urged by the spring 58. Therefore, even if the recording head 5 has moved above the cap 80, there is no likelihood that both will come in contact with each other. Further, the slider 56 has moved toward the printing region by a distance equivalent to the length L of the meshing hole 60 of the lever 59 while urged by a return spring 61, so that the stopper surface 63*b* of the cap holder 63 confronts the cleaner unit 10. As a result, even if the sheet forward motor 7 is rotated reversely, i.e., in such a direction as to drive out the cleaner unit 10 toward the recording head 5 travelling region, the cap holder 63 blocks the cleaner unit 10 from plunging into the recording head 5 travelling region. Hence, any situation affecting the recording operation can be prevented.

Figure 14A:
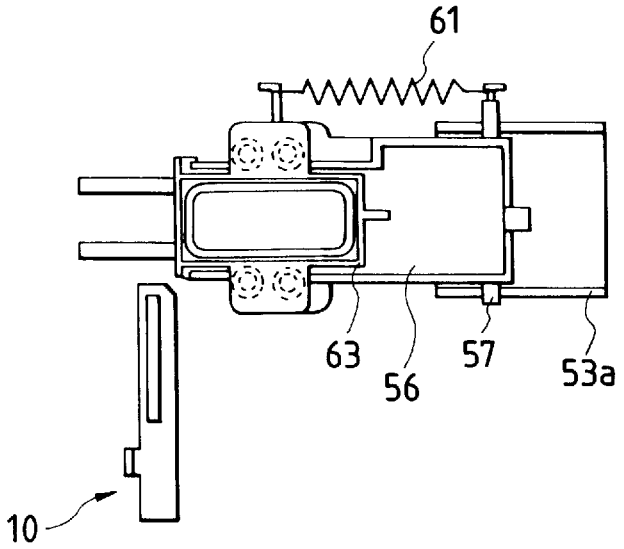
FIGS. 14(*a*) and 14(*b*) are a plan view and a side view respectively showing a process for causing the carriage to lift the slider out of the operations of the cleaner unit and the capping unit.
Figure 14B:
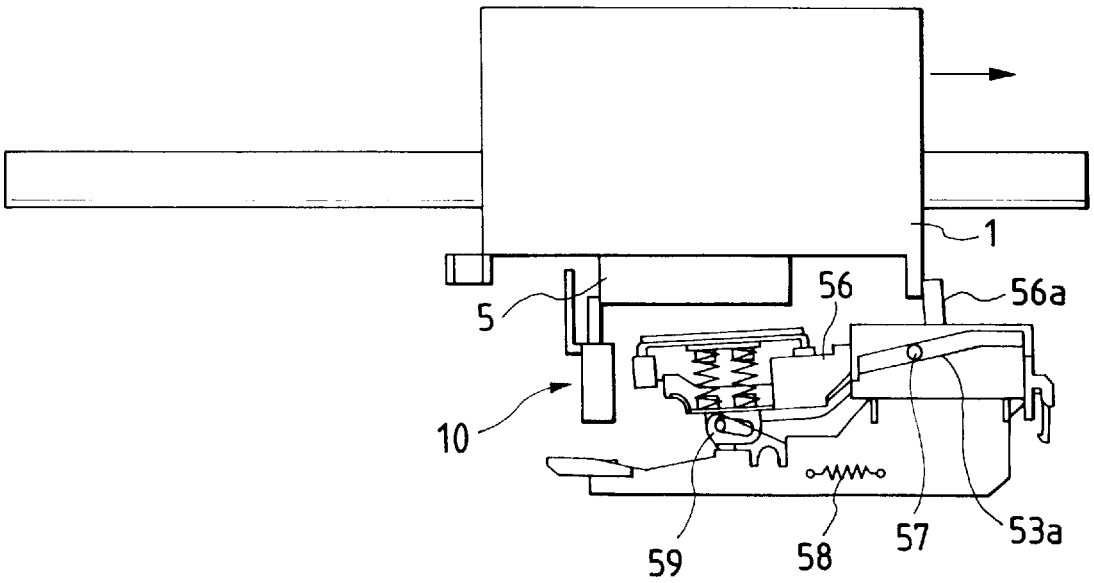

When the recording operation has been brought to an end, the carriage 1 is moved to the home position by the carriage motor 2. During the movement of the carriage 1, the carriage 1 comes into contact with the contact piece 56*a* of the slider 56 as shown in FIG. 14, so that slider 56 is moved toward the termination end portion against the return spring 61 while rotating the lever 59 against the spring 58. During the movement of the slider 56, the lever 59 is lifted in association with the movement of the carriage 1, and the projections 57 of the slider 56 move along the sloped portions 53*a* of the cam grooves 53. When the slider 56 pushed by the carriage 1 has the projections 57 thereof moved to the horizontal portions 53*b* of the cam grooves 53, the cap 80 has, first of all, one point on the termination end portion side thereof come in contact with the nozzle surface of the recording head 5 with the compression force of all the compression springs 70 during such movement of the projections 57 along the horizontal portions 53*b*, because the cap holder 63 is attached to the slider 56 so that one side on the start end portion side of the cap holder 63 takes a slightly lower position.

Figure 15A:
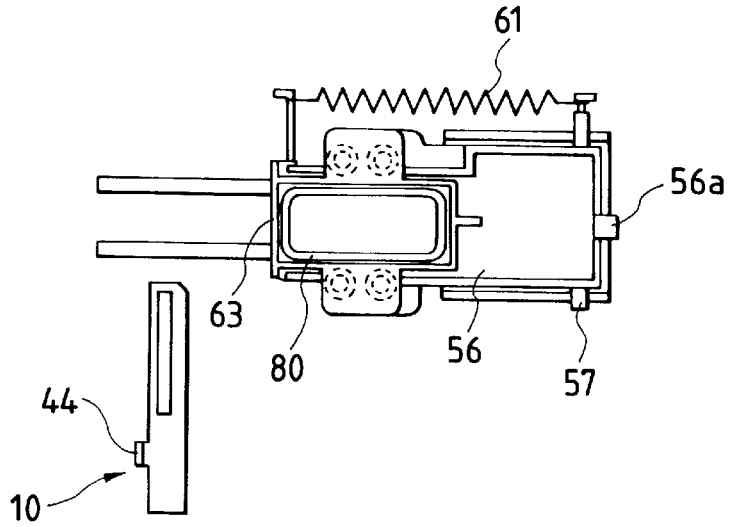
FIGS. 15(*a*) and 15(*b*) are a plan view and a side view respectively showing a condition in which the recording head is sealed, out of the operations of the cleaner unit and the capping unit.
Figure 15B:
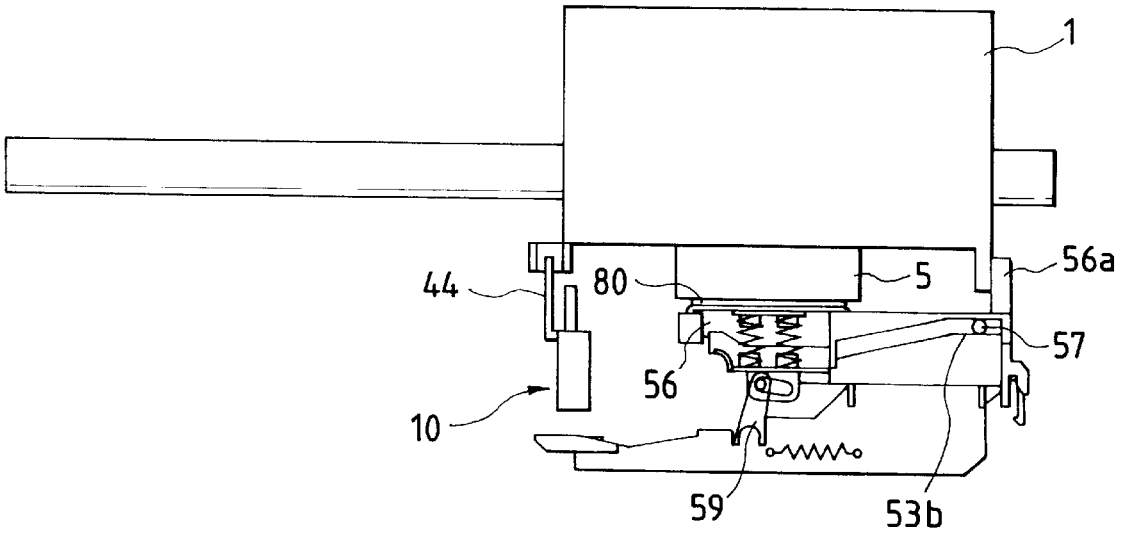

As shown in FIG. 15, when the slider 56 has reached the termination end portion, the entire circumference of the cap 80 receives the compression force from all the compression springs 70, so that the cap 80 comes in contact with the nozzle surface of the recording head 5 to thereby seal the nozzle surface reliably. From the initial condition in which the cap 80 comes in contact with the nozzle surface to the final condition in which the cap 80 totally seals the nozzle surface, the projections 57 are substantially flush with the sealing surface 80*a* of the cap 80 ($\Delta H \approx 0$). Therefore, the amount of horizontal displacement _L1 is very small, i.e., the amount of displacement resulting from the slider 56 rotating about the projections 57 at the time of moving to the capping position as shown in FIG. 6(*c*), so that the cap 80 can come in contact with the nozzle surface of the recording head 5 reliably, which in turn allows the cap 80 to seal the nozzle surface reliably.

In the thus sealed condition, the stopper surface 63*b* of the cap holder 63 is evacuated from the cleaner unit 10. Therefore, when the sheet forward motor 7 is rotated reversely, the cleaner cam 29 that has rotated counterclockwise as viewed in FIG. 3 together with the gear 26 causes the cleaner unit 10 to project toward the recording head 5 travelling region by the arm 28 thereof. When the sheet forward motor 7 is rotated in the reverse direction so that the cleaning unit 10 comes immediately before the cleaning position, the retaining projection 44 of the cleaner unit 10 gets meshed with the carriage stopper 1*a* to thereby lock the carriage 1, so that unnecessary movement of the carriage 1 is blocked as shown in FIG. 10.

When the recording head 5 has been clogged due to the printing operation and the like performed over a long period of time, the recording head 5 must be cleaned. Not only the sheet forward motor 7 is rotated forwardly from the sealed condition shown in FIG. 10 to thereby discharge the recording sheet, but also the cleaner unit 10 is evacuated from the recording head 5 to thereby unlock the carriage as shown in FIG. 15 (S114). Since the carriage 1 is set movable as a result of such operation, when the carriage 1 is moved further toward the termination end side up to a location shown in FIG. 16 from the capped condition shown in FIG. 15, the operation rod 79 disposed on the slider 56 comes in contact with the contact piece 76 of the cap frame 51 to thereby open the valve 77 of the valve seat 75 to the atmosphere (S115).

Figure 17A:
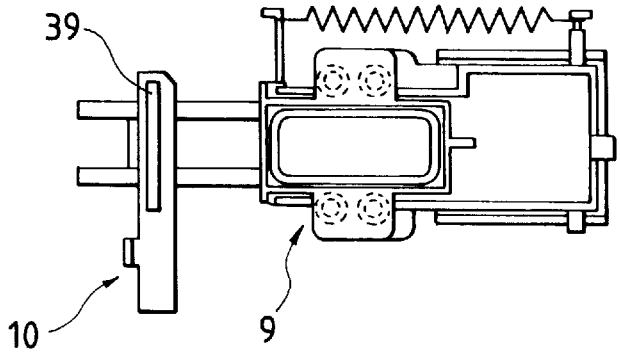
FIGS. 17(*a*) and 17(*b*) are a plan view and a side view respectively showing a condition in which the cleaner unit has been set ready for cleaning out of the operations of the cleaner unit and the capping unit.
Figure 17B:
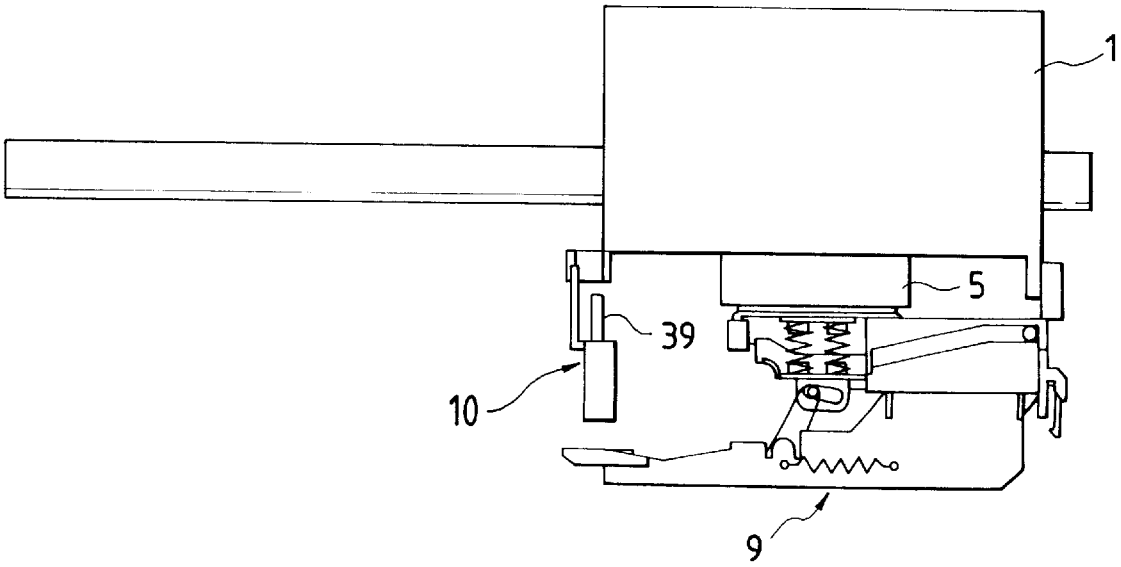

When the sheet forward motor 7 is rotated reversely under this condition, the cleaner unit 10 comes to project into the recording head 5 travelling path, so that the cleaner unit 10 is set to the cleaning position as shown in FIG. 17 (Si16). The current reverse rotation of the sheet forward motor 7 comes after the last forward rotation. Therefore, the current reverse rotation of the sheet forward motor 7 is not transmitted to the pump wheel 33 by the intermediate transmission wheel 32, so that the pump unit 11 remains inoperative.

Figure 18A:
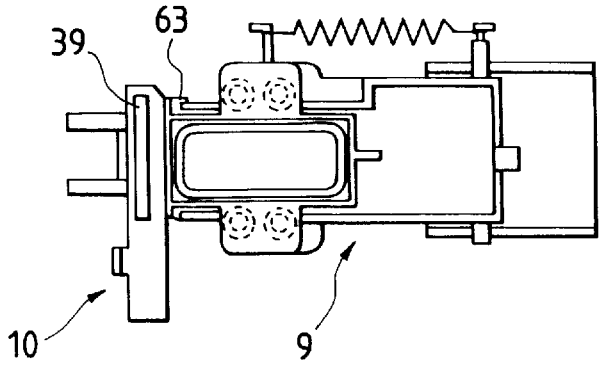
FIGS. 18(*a*) and 18(*b*) are a plan view and a side view respectively showing a cleaning condition out of the operations of the cleaner unit and the capping unit.
Figure 18B:
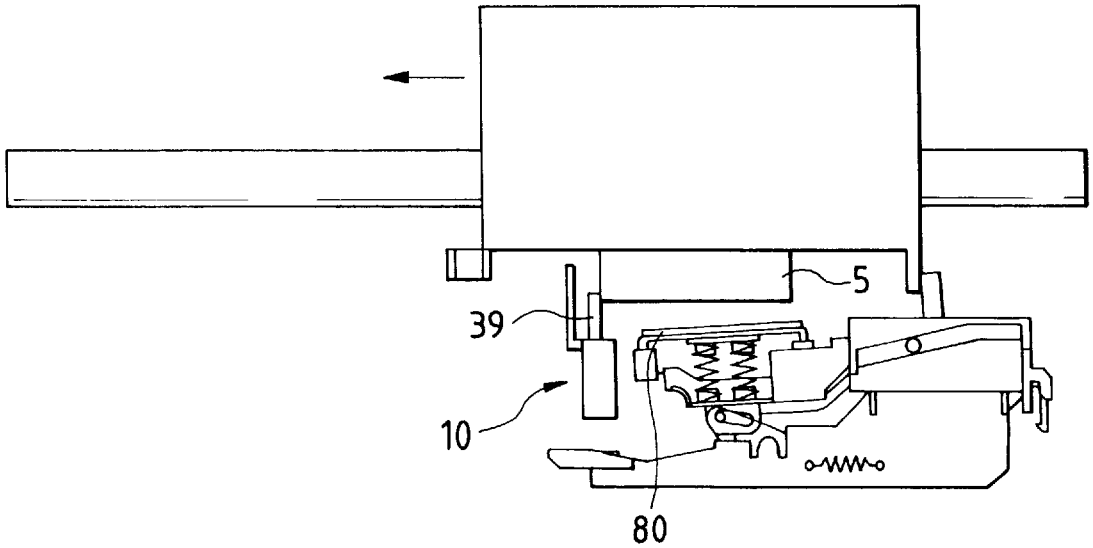

Then, by moving the carriage 1 toward the start end portion, the cleaning blade 39 comes into contact with the nozzle surface of the recording head 5 as shown in FIG. 18. Therefore, by moving the carriage 1 to a wipe end position, the ink deposited on the nozzle surface can be wiped off (S117). Since the cleaning blade 39 is in contact with the cap holder 63 at this time, the ink deposited onto the cleaning blade 39 as a result of the wiping operation is transferred to the cap holder 63 or to the cap 80. Therefore, the amount of ink remaining on the cleaning blade 39 can be kept as small as possible, which in turn ensures reliability in the wiping operation.

Figure 16A:
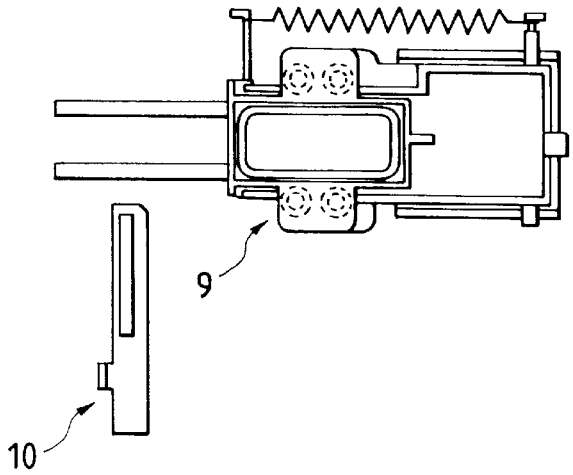
FIGS. 16(*a*) and 16(*b*) are a plan view and a side view respectively showing an idle sucking condition out of the operations of the cleaner unit and the capping unit.
Figure 16B:
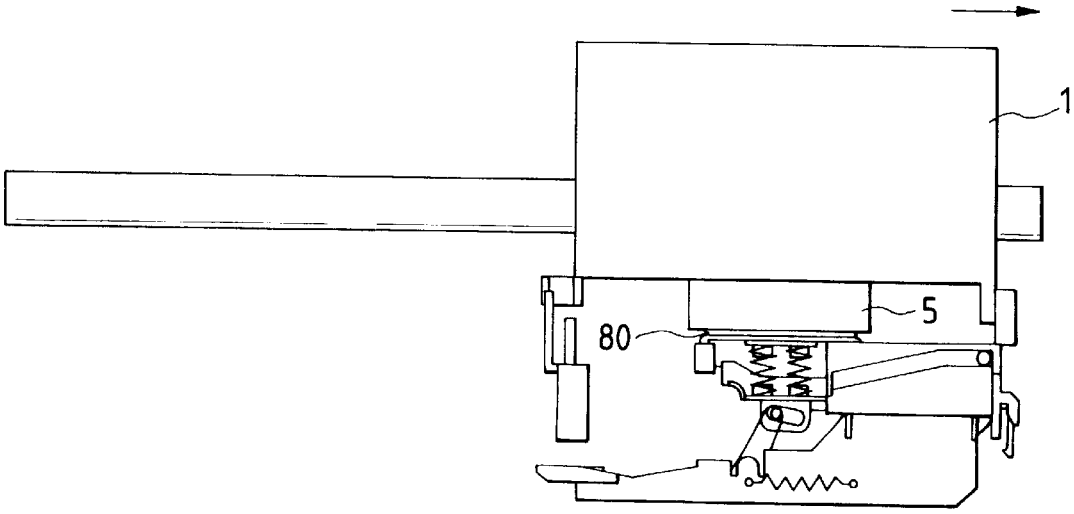
Figure 19A:
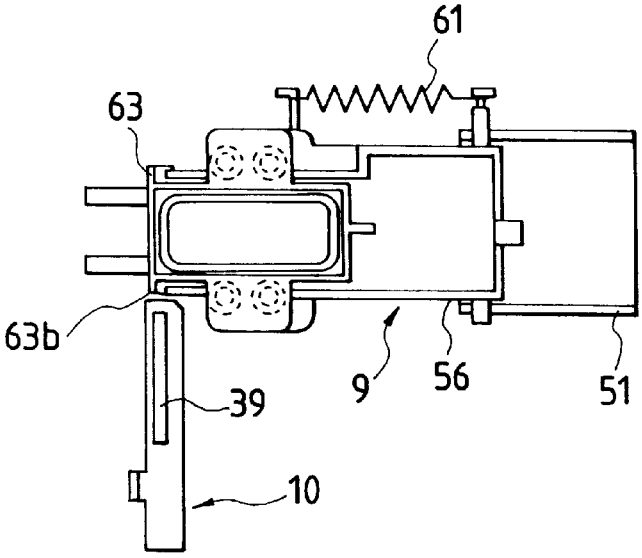
FIGS. 19(*a*) and 19(*b*) are a plan view and a side view respectively showing a condition in which the cleaner unit has been reset after cleaning out of the operations of the cleaner unit and the capping unit.
Figure 19B:
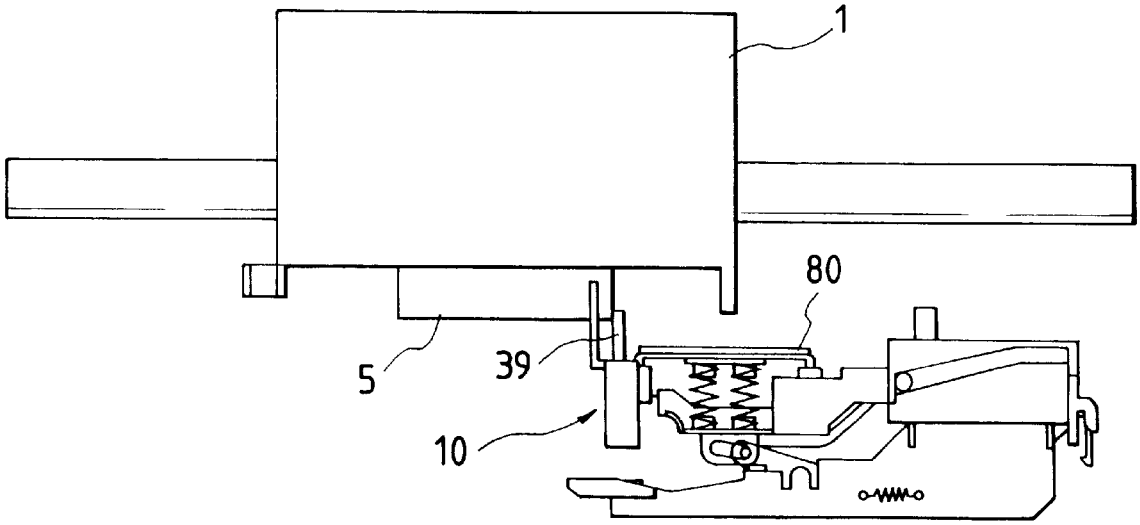
Figure 20:
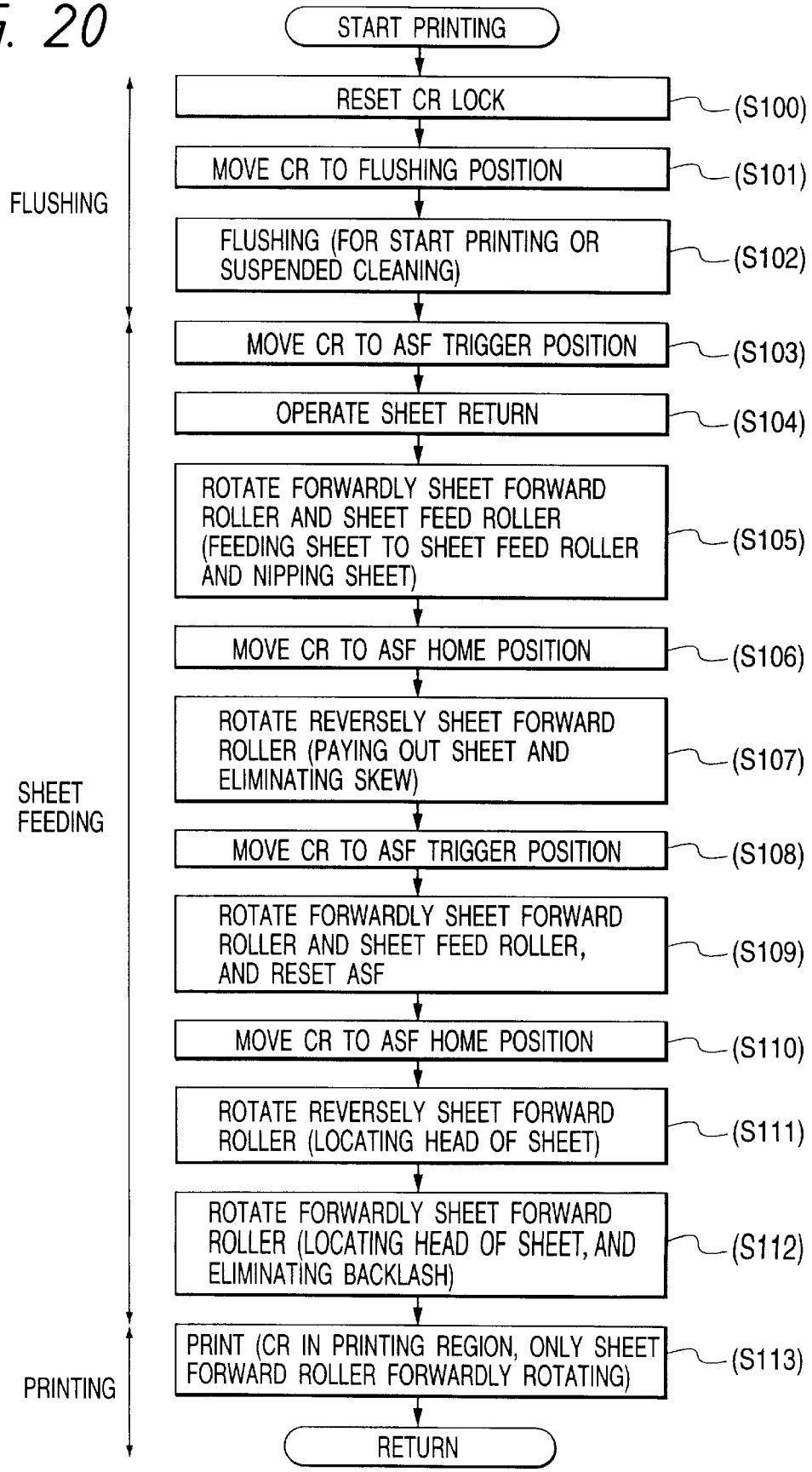
FIG. 20 is a flowchart showing a printing operation of the apparatus.
Figure 21:
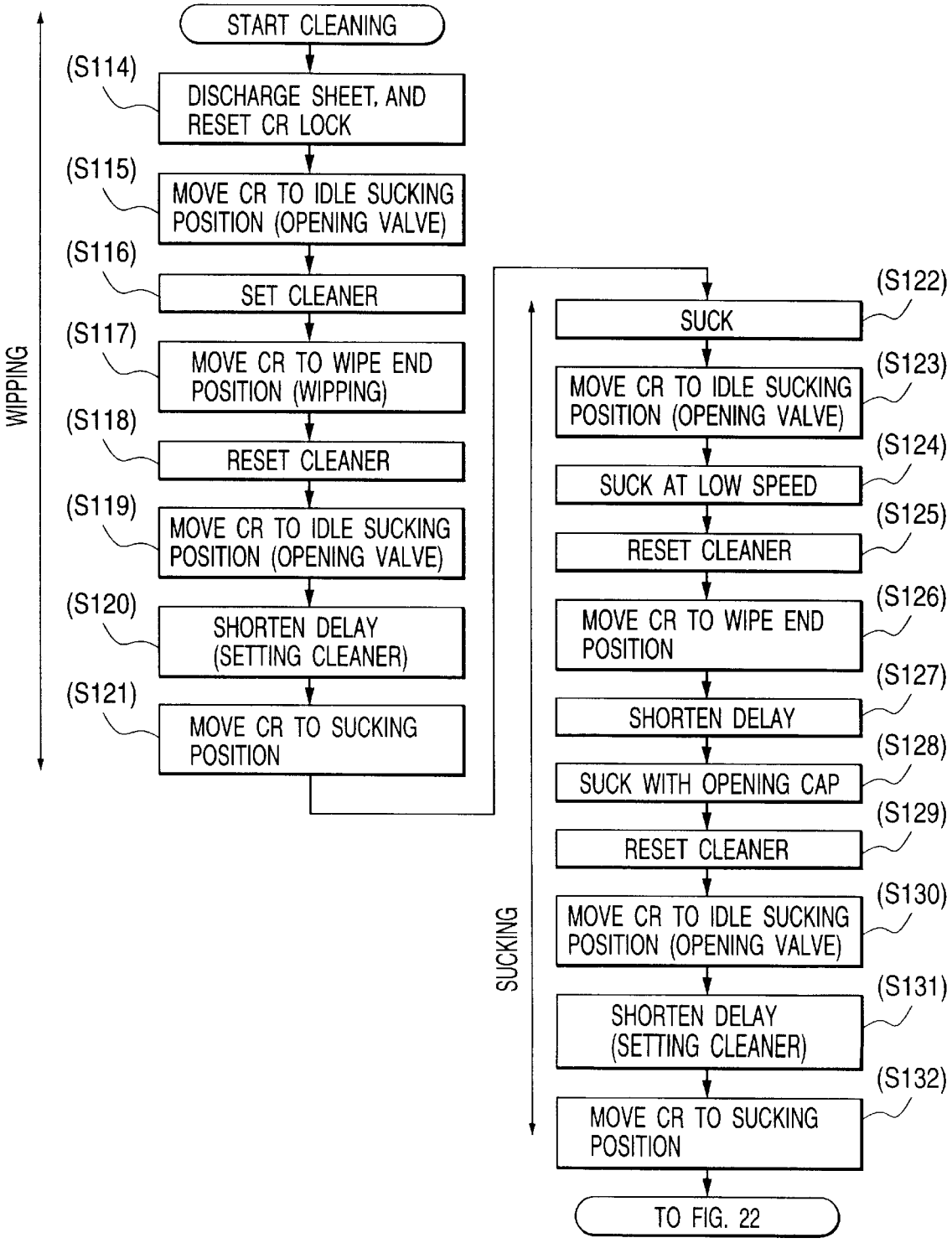
FIG. 21 is a flowchart showing the first half of the cleaning operation of the apparatus.
Figure 22:
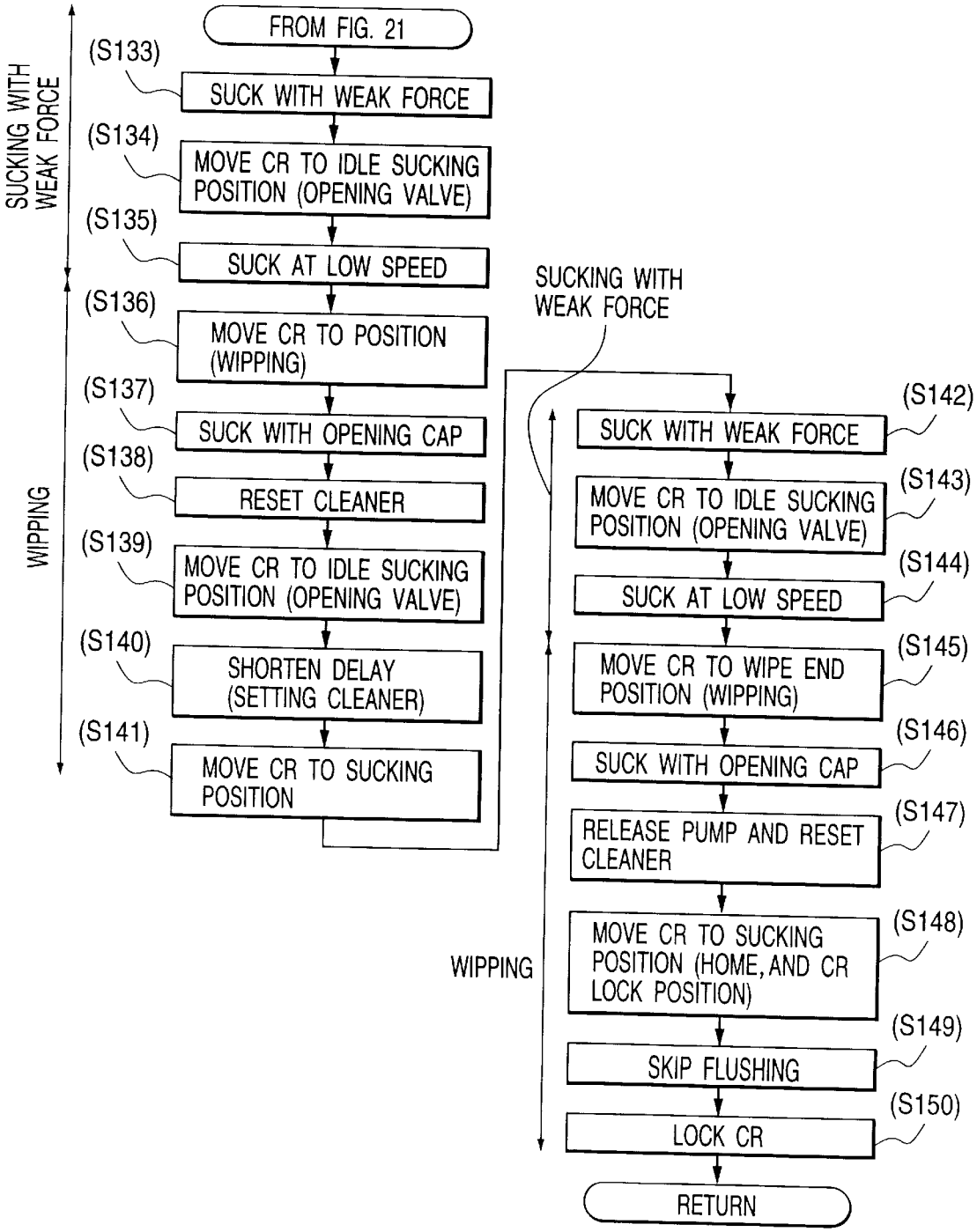
FIG. 22 is a flowchart showing the latter half of the cleaning operation of the apparatus.

Upon completing of the cleaning operation, the sheet forward motor 7 is rotated forwardly in an amount equal to the reverse rotation of the motor 7, so that not only the cleaner unit 10 is returned to the evacuated position again as shown in FIG. 19 (S118), but also the carriage 1 is moved to an idle sucking position to thereby move the slider 56 to the termination end portion and set the recording head 5 ready for idle sucking as shown in FIG. 16 (S119). The sheet forward motor 7 is rotated in an amount equivalent to a transmission delay caused by the intermediate transmission wheel 32 (S120), and the carriage 1 is moved slightly toward the start end portion to thereby set the recording head 5 in the sealed condition shown in FIG. 15 (S121). As a result of this operation, the slider 56 moves away from the termination end portion, so that the operation rod 79 on the slider 56 also moves away from the contact piece 76 of the cap frame 51 and hence closes the valve 77 with the urging force of the spring 78.

When the sheet forward motor 7 is rotated reversely under this condition, the motive force is transmitted to the pump unit 11, and a sucking force is applied to the cap 80. As a result, the ink is sucked from the recording head 5 at high pressure to be forcibly discharged therefrom, which in turn unclogs the nozzles (S122). The carriage 1 is moved slightly toward the termination end portion to thereby set the recording head 5 in the idle sucking position shown in FIG. 16 (S123), and the sheet forward motor 7 is rotated reversely at a low speed to thereby allow only the ink remaining in the cap 80 to be sucked without applying unnecessary sucking force to the recording head 5, and the sucked ink is thereafter discharged into a waste ink tank (not shown) (S124). Upon completing the idle sucking, the cleaner unit 10 is set in the position shown in FIG. 17, so that the sheet forward motor 7 is rotated forwardly to evacuate the cleaner unit 10 (S125) and to move the carriage 1 to the wipe end position (S126).

Upon completing the cleaning operation, the sheet forward motor 7 is rotated reversely to thereby eliminate a transmission delay of the intermediate transmission wheel 32 caused by the last forward rotation of the motor 7 (S127) and to operate the pump unit 11, so that the pump unit 11 sucks the ink remaining in the cap 80 with a strong sucking force without applying sucking force to the recording head 5 (S128).

Then, the sheet forward motor 7 is rotated forwardly to thereby evacuate the cleaner unit 10 from the recording head 5 travelling path as shown in FIG. 16 (S129). Further, the carriage 1 is moved toward the termination end portion again to thereby allow the cap 80 to seal the recording head 5 in the idle sucking condition as shown in FIG. 16 (S130). Since the cleaner unit 10 has been evacuated from the recording head 5 travelling path, there is no likelihood that the cleaning blade 39 will come in contact with the nozzle surface of the recording head 5.

The sheet forward motor 7 is rotated reversely to thereby eliminate a transmission delay caused by the intermediate transmission wheel 32 (S131), and the carriage 1 is moved slightly toward the start end portion to thereby set the recording head 5 in the sealed condition shown in FIG. 15 (S132). As a result of this operation, the slider 56 moves away from the termination end portion, so that the valve 77 is closed by the operation rod 79.

When the sheet forward motor 7 is rotated reversely at a low speed under this condition, the motive force is transmitted to the pump unit 11 to thereby allow a weak sucking force to be applied to the cap 80. As a result, the ink is forcibly discharged out of the recording head 5 with the weak sucking force, which in turn allows the meniscuses in the nozzles to be recovered (S133). Upon completing the sucking operation, the carriage 1 is moved slightly toward the termination end portion to thereby set the recording head 5 in the idle sucking condition shown in FIG. 16 (S134). Then, the sheet forward motor 7 is rotated reversely at a low speed, so that such a sucking force as not to cause the ink to be jetted out of the recording head 5 is applied to suck only the ink remaining in the cap 80, and the sucked ink is thereafter discharged into the not shown waste ink tank (S135). Upon end of the idle sucking operation, the cleaner unit 10 is set as shown in FIG. 17 by the low-speed reverse rotation of the sheet forward motor 7 performed in the aforementioned step (S135). Therefore, when the carriage 1 is moved to the wipe end position as shown in FIG. 18, wiping operation is performed (S136).

The sheet forward motor 7 is rotated reversely upon end of the cleaning operation. Since the current reverse rotation of the motor 7 is a succession of the last reverse rotation, the pump unit 11 is operated without having any transmission delay caused by the intermediate transmission wheel 32. As a result, the ink remaining in the cap 80 is sucked at a high negative pressure without applying sucking force to the recording head 5 (S137). The sheet forward motor 7 is rotated forwardly in an amount equivalent to a transmission delay caused by the intermediate transmission wheel 32 to thereby evacuate the cleaner unit 10 from the recording head 5 travelling path as shown in FIG. 19 (S138). Further, the carriage 1 is moved toward the termination end portion again to thereby allow the cap 80 to seal the recording head 5 in the idle sucking condition as shown in FIG. 16 (S139). Since the cleaner unit 10 has been evacuated from the recording head 5 travelling path, there is no likelihood that the cleaning blade 39 will come in contact with the nozzle surface of the recording head 5. The sheet forward motor 7 is rotated reversely to thereby eliminate a transmission delay of the intermediate transmission wheel 32 caused by the last forward rotation of the motor 7 (S140), and the carriage 1 is moved slightly toward the start end portion to thereby set the recording head 5 in the sealed condition shown in FIG. 15 and close the valve 77 (S141).

When the sheet forward motor 7 is rotated reversely at a low speed under this condition, the motive force is transmitted to the pump unit 11 to thereby allow a weak sucking force to be applied to the cap 80. As a result, the ink is forcibly discharged out of the recording head 5 with the weak sucking force, which in turn allows the meniscuses in the nozzles to be recovered (S142). Upon completing the sucking operation, the carriage 1 is moved slightly toward the termination end portion to thereby set the recording head 5 in the idle sucking condition shown in FIG. 16 (S143). Then, the sheet forward motor 7 is rotated reversely at a low speed, so that only the ink remaining in the cap 80 is sucked by such a sucking force as not to cause the ink to be jetted out of the recording head 5 (S144).

Upon completing of the idle sucking operation, the cleaner unit 10 has already been set as shown in FIG. 17 by the low-speed reverse rotation of the sheet forward motor 7 performed in the aforementioned step (S144). Therefore, by moving the carriage 1 to the wipe end position shown in FIG. 18, the wiping operation is performed (S145).

The sheet forward motor 7 is rotated reversely upon completing of the cleaning operation. Since the current reverse rotation of the motor 7 succeeds the last reverse rotation, the pump unit 11 is operated without having any transmission delay caused by the intermediate transmission wheel 32. Therefore, the pump unit 11 sucks the ink remaining in the cap 80 with a strong sucking force with the cap 80 released from the recording head 5, and the ink in the cap 80 is thereafter discharged into the waste ink tank reliably (S146). When the sheet forward motor 7 is rotated in the forward direction until the projection 32*b* of the intermediate transmission wheel 32 comes in contact with the projection 33*a* of the pump wheel 33 to thereby rotate the pump wheel 33 slightly, the cleaner unit 10 is reset, and the rollers 34 of the pump unit 11 move toward the center of the pump wheel 33 to thereby move away from the tube 35, so that the pump unit 11 is set in the released condition (S147).

When all the cleaning processes have been terminated, the carriage 1 is moved to the home position to be set in the condition shown in FIG. 15. As a result, the entire circumference of the cap 80 comes into contact with the nozzle surface of the recording head 5 while receiving the compression force of all the compression springs 70, so that the cap 80 can seal the recording head 5 reliably (S148). Then, by skipping the flushing operation (S149), the sheet forward motor 7 is rotated reversely to thereby mesh the retaining projection 44 of the cleaner unit 10 with the carriage stopper la as shown in FIG. 10, so that the carriage 1 is locked to thereby block unnecessary movement thereof (S150).

It is contemplated that numerous modifications may be made to the Ink Jet Recording Apparatus of the present invention without departing from the spirit and scope of the invention as defined in the following claims.

What is claimed is:

1. An ink jet recording apparatus, comprising:

single drive means rotating in a forward direction and a reverse direction;

recording sheet feed/discharge means for feeding and discharging recording sheets and coupled to said drive means when said drive means rotates in said forward direction;

ink sucking means for sucking ink; and coupling means for transporting a driving force generated in said drive means to said ink sucking means while causing a time lag;

when ssid drive means rotates in said reverse direction.

2. An ink jet recording apparatus according to claim 1, wherein said coupling means for causing said time lag comprises:

a rotating drive body having a first projection;

a rotating driven body having a second projection; and an intermediate transmission rotating body interposed between said rotating drive body and said rotating driven body so as to be rotatable therebetween, said intermediate transmission rotating body having a first corresponding projection on a front surface which is contactable with said first projection of said rotating drive body to prevent relative rotation therebetween, and said intermediate transmission rotating body having a second corresponding projection on a back surface which is contactable with said second projection of said rotating driven body to prevent relative rotation therebetween.

3. An ink jet recording apparatus according to claim 1, wherein said ink sucking means is directly connected to said single drive means by a first transmission mechanism and said recording sheet feed/discharge means is connected to said single drive means by a second transmission mechanism.

4. An ink jet recording apparatus according to claim 1, further comprising cleaning means coupled to the drive means for performing a cleaning operation when said drive means operate said ink sucking means to perform an ink sucking operation.

5. An ink jet recording apparatus according to claim 4, wherein said cleaning means is directly connected to said single drive means by a first transmission mechanism and said feed/discharge means is connected to said single drive means by a second transmission mechanism.

6. An ink jet recording apparatus according to claim 1, wherein during said time lag, said drive means rotates and said ink sucking means is prevented from sucking ink.

7. An ink jet recording apparatus, comprising:

a carriage for carrying a recording head provided with a nozzle surface along a travelling axis in a recording head travelling region;

cleaning means for cleaning said nozzle surface at a cleaning means operating region; and capping means for covering said nozzle surface of said recording head and being movable in a direction parallel to said travelling axis such that said capping means enters into said cleaning means operating region.

8. An ink jet recording apparatus according to claim 7, wherein one side surface of said capping means includes a stopper surface to prevent said cleaning means from entering into said recording head travelling region.

9. An ink jet recording apparatus according to claim 7, wherein said cleaning means further comprises carriage fixing means for restricting movement of said carriage when said carriage fixing means is meshed with the carriage.

10. An ink jet recording apparatus according to claim 7, wherein said capping means further comprises guide means for guiding said capping means in said cleaning means operating region toward a lower position in which the capping means does not contact said recording head.

11. An ink jet recording apparatus according to claim 10, wherein said guide means comprises:

at least one horizontal cam;

at least one link; and slide means being disposed on the link.

12. An ink jet recording apparatus according to claim 7, wherein said cleaning means is movable into and out of said cleaning means operating region.

13. An ink jet recording apparatus having a capping unit, the capping unit comprising:

a slider biased by one of a recording head and a carriage carrying the recording head to follow a carriage movement over a base table while vertically moving in coincidence with said carriage movement;

a holder supported by said slider and urged toward said recording head by springs positioned to an outside of a sealing region of said recording head; and a cap for sealing a nozzle surface of said recording head, said cap accommodated in said holder and fabricated from an elastic material.

14. An ink jet recording apparatus having a capping unit according to claim 13, wherein said springs are positioned symmetrically about an axis of said carriage movement and orthogonally to said carriage movement.

15. An ink jet recording apparatus having a capping unit according to claim 14, wherein each of said springs has substantially equal elastic properties.

16. An ink jet recording apparatus having a capping unit according to claim 13, wherein said holder is supported by said slider at three support points extended along an axis of said carriage movement.

17. An ink jet recording apparatus having a capping unit according to claim 16, wherein a distance between one of said three support points and said recording head is different than a distance between either of the remaining two of said three support points and said recording head.

18. An ink jet recording apparatus having a capping unit according to claim 17, wherein the difference is at least 1 mm.

19. An ink jet recording apparatus having a capping unit according to claim 17, wherein an angle of inclination of said holder with respect to said nozzle surface is at least 2 degrees.

20. An ink jet recording apparatus having a capping unit according to claim 13, wherein the capping unit further comprises:

valve means provided with an opening; and means for communicating with the atmosphere formed substantially on a longitudinal centerline of said cap and communicating with said opening of said valve means.

21. An ink jet recording apparatus having a capping unit according to claim 20, wherein a tube is connected to said opening of said valve means and extends vertically from a bottom surface of said holder.

22. An ink jet recording apparatus having a capping unit according to claim 20, wherein a tube extending in parallel to an axis of said carriage movement is connected to said opening of said valve means communicating with said means for communicating with the atmosphere.

23. An ink jet recording apparatus comprising:

a base table having supports with sloped portions and horizontal portions;

an arm rotatably mounted on said base table;

a slider having a termination end portion side with projections contacting said supports of said base table and a bottom surface of a start end portion side connected to said arm of said base table, said slider being biased by one of a recording head and a carriage carrying said recording head to follow a carriage movement while moving vertically in coincidence with said carriage movement such that said slider pivots about said projections; and a capping unit with an elastic cap having a sealing surface for sealing a nozzle surface of said recording head, said capping unit connected to said slider and urged by springs so that said sealing surface is substantially coplanar with said projections and spaced a distance at least equivalent to a length of said cap from said projections and toward said start end portion side.

24. An ink jet recording apparatus according to claim 23, wherein said projections are formed on opposed sides of said cap.

25. An ink jet recording apparatus according to claim 23, wherein said slider is held substantially horizontal while said slider is moving.

26. An ink jet recording apparatus according to claim 13, wherein said arm lifts said slider by an amount which is greater than an amount by which said sloped portion of said supports lifts said slider.

27. An ink jet recording apparatus according to claim 23, wherein said sloped portion is formed horizontally with said horizontal portion such that an amount of lift provided by said sloped portion is substantially zero.

28. An ink jet recording apparatus having a capping unit according to claim 23, wherein said arm is connected through an elongated hole provided in said slider.

* * * * *